US006761547B2

(12) United States Patent
Takagi et al.

(10) Patent No.: US 6,761,547 B2
(45) Date of Patent: Jul. 13, 2004

(54) TROCHOID GEAR TYPE FUEL PUMP

(75) Inventors: Masatoshi Takagi, Takahama (JP); Motoya Ito, Hekinan (JP); Katsuhiko Kusagaya, Kariya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/254,514

(22) Filed: Sep. 26, 2002

(65) Prior Publication Data

US 2003/0026722 A1 Feb. 6, 2003

Related U.S. Application Data

(62) Division of application No. 09/811,491, filed on Mar. 20, 2001.

(30) Foreign Application Priority Data

Mar. 27, 2000 (JP) ..... 2000-90748
Mar. 30, 2000 (JP) ..... 2000-97793
Nov. 6, 2000 (JP) ..... 2000-337685

(51) Int. Cl.[7] ..... F04C 18/00

(52) U.S. Cl. ..... 418/171; 418/15; 418/75; 418/77; 418/79

(58) Field of Search ..... 418/171, 161, 418/15, 75, 77, 79

(56) References Cited

U.S. PATENT DOCUMENTS 2,531,808 A 11/1950 Eames
3,045,778 A 7/1962 Mosbacher
3,106,163 A 10/1963 Mosbacher
3,697,201 A 10/1972 Eickmann
5,547,349 A * 8/1996 Kimura et al. ..... 417/282
6,082,984 A * 7/2000 Matsumoto et al. ..... 418/171
6,102,684 A 8/2000 Tuckey

FOREIGN PATENT DOCUMENTS

JP 55-007943 1/1980
JP 61-081588 4/1986
JP 01247767 A * 10/1989 ..... F03C/2/08
JP 05-079463 3/1993
JP 05-079465 3/1993
JP 5-133347 5/1993
JP 05240166 A * 9/1993 ..... F04C/2/10
JP 05263770 A * 10/1993 ..... F04C/2/10
JP 11-022656 1/1999

* cited by examiner

*Primary Examiner*—Thomas Denion
*Assistant Examiner*—Theresa Trieu
(74) *Attorney, Agent, or Firm*—Nixon & Vanderhye PC

(57) ABSTRACT

Two-inner gears are overlapped with each other through a partition wall and are eccentrically arranged at an inner peripheral side of an outer gear, and eccentric directions of both the inner gears are shifted from each other by 180° to the opposite side. By this, loads in an outer diameter direction due to a rise in fuel pressure affect one outer gear from the two inner gears oppositely to each other by 180°, so that an eccentric load is not generated, and sliding resistance of the outer gear to a cylindrical casing becomes small. Further, the number of teeth of the outer gear is made odd, and the number of teeth of the inner gears is made even.

13 Claims, 19 Drawing Sheets

TROCHOID GEAR TYPE FUEL PUMP

CROSS REFERENCE TO RELATED APPLICATION

This application is a division of application Ser. No. 09/811,491, filed Mar. 20, 2001, the entire contents of which is hereby incorporated by reference in this application.

BACKGROUND OF THE INVENTION

1. Field of the Invention

The present invention relates to a trochoid gear type fuel pump constituted by eccentrically arranging an inner gear at an inner peripheral side of an outer gear.

2. Description of the Related Art

In recent years, for the purpose of improving fuel discharge performance of a fuel pump mounted in a vehicle, it has been considered to adopt a trochoid gear type fuel pump. As shown in FIG. 7, the trochoid gear type fuel pump is constructed such that an inner gear 3 having outer teeth is eccentrically arranged at an inner peripheral side of an outer gear 2 having inner teeth which is rotatably housed in a cylindrical pump casing 1, both the gears 2, 3 are engaged with each other to form pump chambers 4 between the teeth of both the gears 2, 3, and a driving motor (not shown) drives and rotates the inner gear 3 to rotate the outer gear 2, so that while the pump chambers 4 between the teeth of both the gears 2, 3 are moved in a rotation direction, the volumes of the pump chambers 4 are continuously increased and decreased to suck and discharge fuel.

Since this sort of trochoid gear type fuel pump repeats a volume change of the pump chamber 4, a discharge pressure pulsation of a frequency corresponding to the number of teeth of the inner gear 3 is generated, and the discharge pressure pulsation vibrates a fuel tank, fuel piping, a floor panel of a vehicle, and the like, so that there is a problem that noise and vibration becomes large. On this account, in the case where the trochoid gear type fuel pump is used, for the purpose of reducing the noise and vibration, it is necessary to take measures against the noise, for example, a discharge pressure pulsation reducing device is attached to the outside of the fuel pump, or a sound shielding member is bonded to a vehicle body, and therefore, there is a defect that costs are increased.

In the trochoid gear type fuel pump, after fuel is sucked into the pump chamber 4 in a region where the volume of the pump chamber 4 is increased by the rotation of both the gears 2, 3, the fuel in the pump chamber 4 is pressurized and discharged in a region where the volume of the pump chamber 4 is decreased. Here, in the discharge region where the volume of the pump chamber 4 is decreased, the fuel in the pump chamber 4 is pressurized and the pressure of the fuel (fuel pressure) is raised, so that a load in an outer diameter direction is applied to the outer gear 2 by the rise of the fuel pressure. Since such load in the outer diameter direction by the rise of the fuel pressure is not generated in the suction region (suction port side) where the fuel pressure in the pump chamber 4 is lowered, the load in the outer diameter direction to the outer gear 2 affects only the discharge region (discharge port side) where the fuel pressure of the pump chamber 4 is raised, and this becomes an eccentric load to cause a state where a part of the outer gear 2 at the discharge port side is strongly pressed to the inner peripheral surface of the pump casing 1. Thus, sliding resistance (friction loss) of the outer gear 2 to the pump casing 1 becomes large, and the load of the driving motor becomes high by that, so that there are such defects that consumed electric power is increased, and the lowering of the fuel discharge performance and lowering of pump rotation speed are caused.

Further, in FIG. 7, since it is necessary to provide a clearance between the outer periphery of the outer gear 2 and the inner periphery of the pump casing 1 in view of production tolerance, sliding resistance, and the like, there has been a defect that jolting and whirling are produced in the clearance, and by that, the outer gear 2 collides against the inner peripheral surface of the pump casing 1, and noise and vibration become large.

In JP-A-5-133347, a clearance between an outer periphery of an outer gear and an inner periphery of a pump casing is made large, and the outer periphery of the outer gear is elastically supported by an elastic support mechanism at 120° intervals, and when a foreign matter intrudes into the clearance between the outer periphery of the outer gear and the inner periphery of the pump casing, the outer gear moves in the direction opposite to the intruding position of the foreign matter, so that a lock of the outer gear by engagement of the foreign matter is prevented. However, as in this publication, when such structure is adopted that the clearance between the outer gear and the pump casing is made large, and the outer gear is raised in regard to the pump casing by the elastic support mechanism and is elastically supported, it becomes more difficult to reduce the whirling of the outer gear than the prior art, and the whirling of the outer gear is amplified by contraries, so that an adverse effect is produced on the noise and vibration, and results in the increase of noise and vibration.

SUMMARY OF THE INVENTION

The present invention has been made in view of these circumstances, and a first object thereof is to provide a fuel pump which can reduce noise and vibration due to a discharge pressure pulsation at low cost. A second object thereof is to provide a fuel pump which reduces sliding resistance (friction loss) of an outer gear to a pump casing and can realize a reduction in consumed electric power and an improvement in fuel discharge performance of a driving motor.

In order to achieve the first object, a trochoid gear type fuel pump according to a first aspect of the present invention is structured such that two pumps made of an outer gear and an inner gear are provided, and phases of discharge pressure pulsations of the two pumps are shifted from each other by an almost half wavelength (half period) and are merged while interfering with each other. By doing so, when a pressure pulsation wave of fuel discharged from the one pump has a peak, the other has a bottom, and the discharge pressure pulsations of the two pumps interfere with each other to attenuate, so that the discharge pressure pulsation of the fuel pump is greatly reduced, and the noise and vibration due to the discharge pressure pulsation is greatly reduced. By this, the conventional noise measures (discharge pressure pulsation reducing device, sound shielding member, etc.) become unnecessary, and low noise and low vibration can be realized at low cost.

In this case, as a structure where the phases of the discharge pressure pulsations of the two pumps are shifted from each other by an almost half wavelength and are merged, the following two structures are conceivable. For example, if such a structure is adopted that lengths of fuel flow paths from discharge ports of two pumps to a fuel confluent portion are shifted from each other by an almost half wavelength (or odd number times as long as the half wavelength), the phases of the two discharge pressure pulsations are shifted from each other by the almost half wavelength at the fuel confluent portion, and the discharge pressure pulsations interfere with each other to attenuate.

Further, such a structure may be adopted that outer gears of two pumps are integrally formed, two inner gears are eccentrically arranged at an inner peripheral side of one outer gear in a state where they are overlapped with each other through a partition wall, and eccentric directions of both the inner gears with respect to the outer gear are shifted from each other by 180° to the opposite side. According to this structure, in the two inner gears arranged at the inner peripheral side of the outer gear, since the eccentric directions of both are shifted from each other by 180° to the opposite side, fuel pressure rising sides (discharge port) in the two inner gears are shifted from each other by 180° to the opposite side. By this, since loads in the outer diameter direction by the rise of fuel pressure affect the one outer gear from the two inner gears oppositely to each other by 180°, the loads in the outer diameter direction affecting the outer gear are balanced, and an eccentric load hardly affects the outer gear. Thus, there does not occur such a state where the outer gear is strongly pressed to the inner peripheral surface of the pump casing by the fuel pressure, and the sliding resistance (friction loss) of the outer gear to the pump casing becomes lower than the prior art, and by that, the load of the motor is decreased, and the consumed electric power is decreased. Further, since fuel is sucked and discharged by the two inner gears in the outer gear, in cooperation with the foregoing sliding resistance reduction effect, fuel discharge performance can be effectively raised. By this, this structure can achieve both the first and second objects.

Further, such a structure may be adopted that discharge ports through which fuel in a pump chamber is discharged are formed at two places, and phases of discharge pressure pulsations of the discharge ports at the two places are shifted by an almost half wavelength and are merged while interfering with each other. By doing so, the discharge pressure pulsations of the two discharge ports interfere with each other to attenuate, the discharge pressure pulsation is greatly reduced, and the noise and vibration due to the pressure pulsation is greatly reduced. By this, as compared with the case where two pumps are provided, the number of parts can be decreased and the structure can be simplified, and miniaturization, reduction in weight, and reduction in cost can be realized.

Further, a third object of the present invention is to provide a trochoid gear type fuel pump which can reduce noise and vibration due to jolting and whirling.

In order to achieve the above object, according to an aspect of the present invention, a trochoid gear type fuel pump is provided with elastic press means for pressing an outer gear to a cylindrical pump casing in one direction by an elastic force. When the outer gear is pressed to the pump casing in one direction, since the outer gear rotates in a state where it is pressed to a constant position of an inner peripheral surface of the pump casing, jolting and whirling of the outer gear can be suppressed, and noise and vibration due to the jolting and whirling can be effectively reduced.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PREFERRED EMBODIMENTS (First Embodiment)

Figure 1:
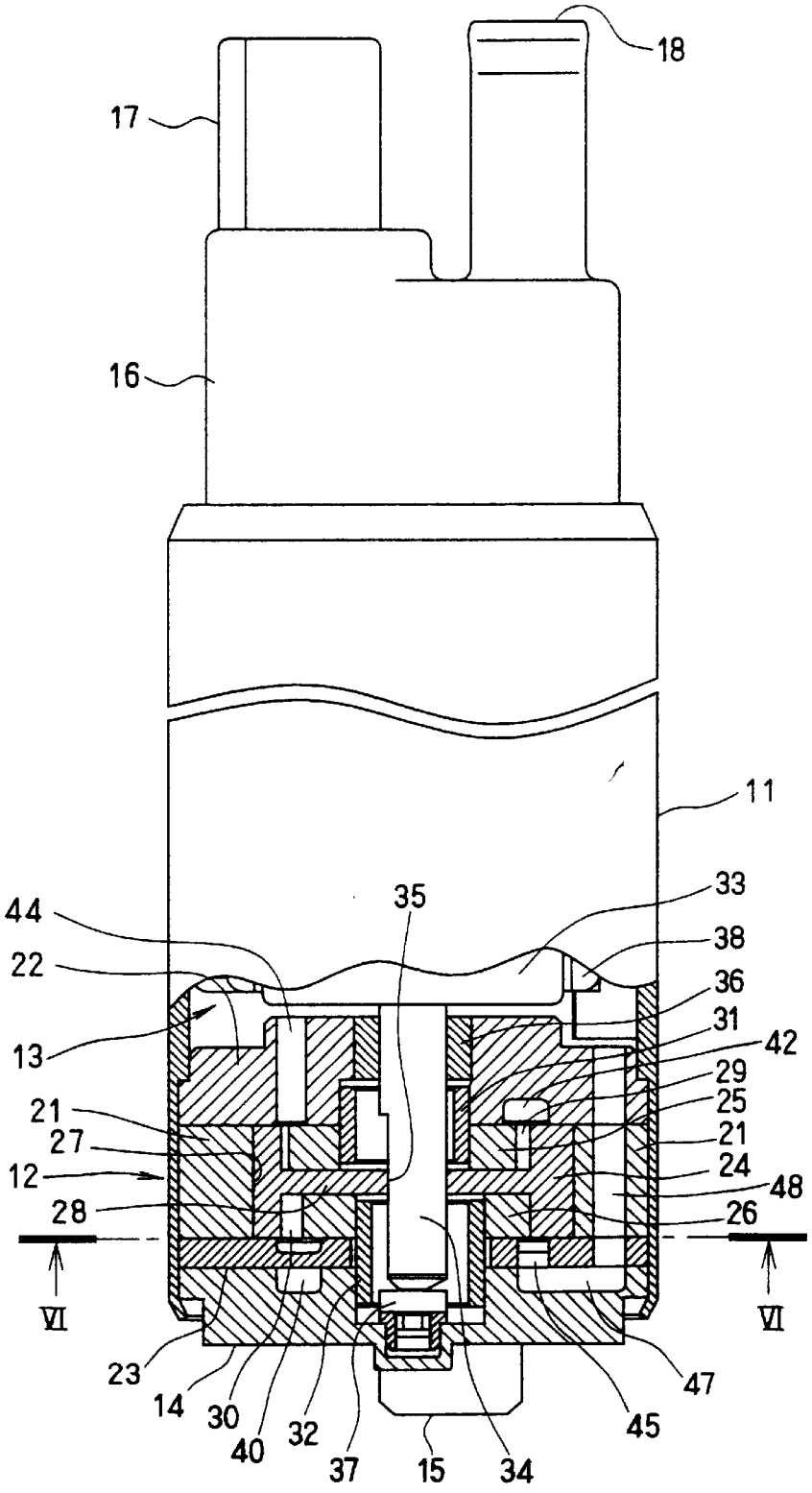
FIG. 1 is a longitudinal cross-sectional view showing a pump portion of a fuel pump (first embodiment)
Figure 2:
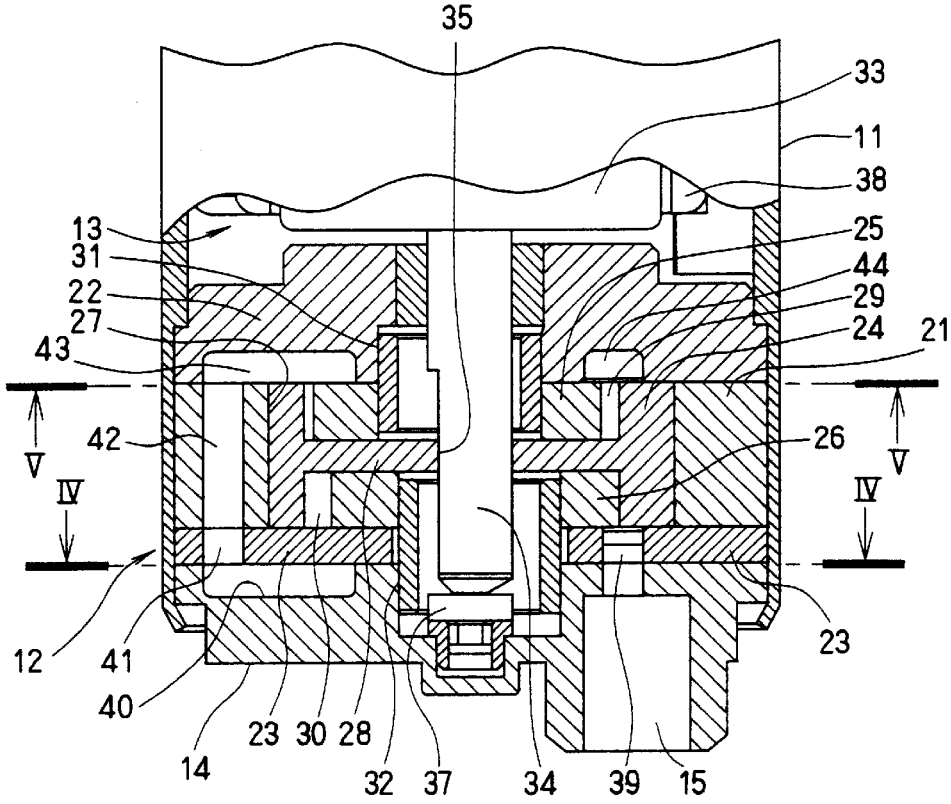
FIG. 2 is a cross-sectional view taken along line II—II in FIG. 3 (first embodiment)
Figure 3:
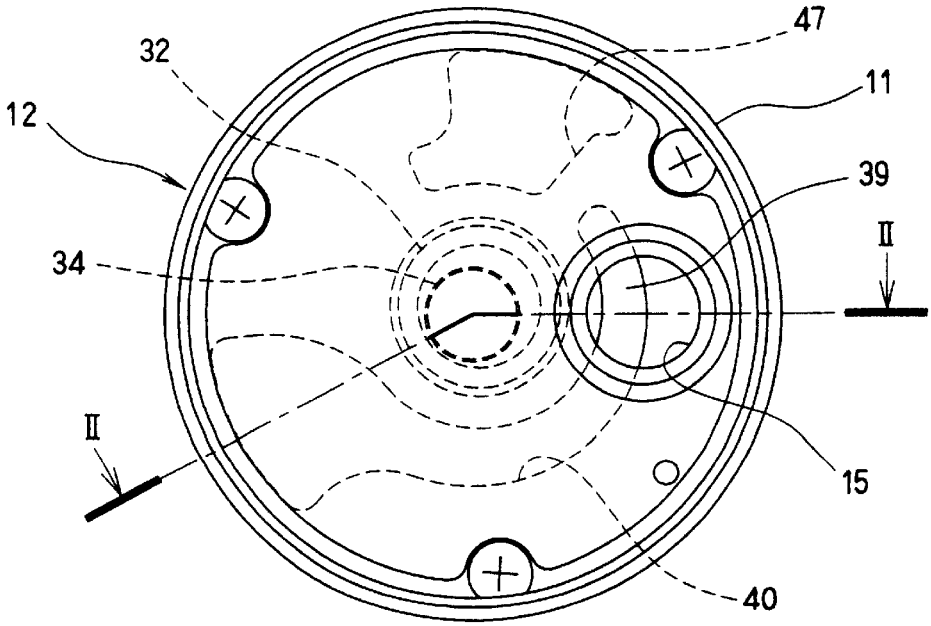
FIG. 3 is a bottom view showing the fuel pump (first embodiment)
Figure 4:
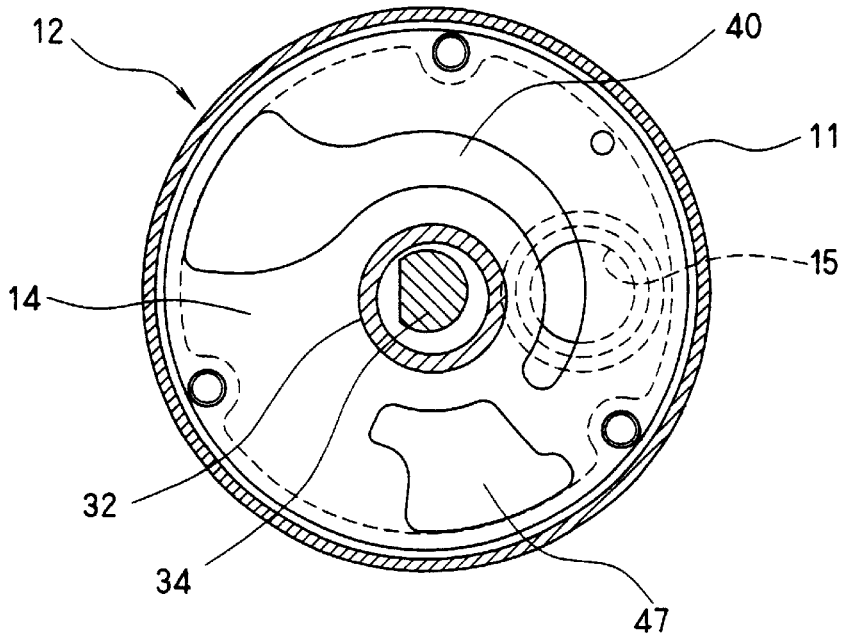
FIG. 4 is a cross-sectional view taken along line IV—IV in FIG. 2 (first embodiment)
Figure 5:
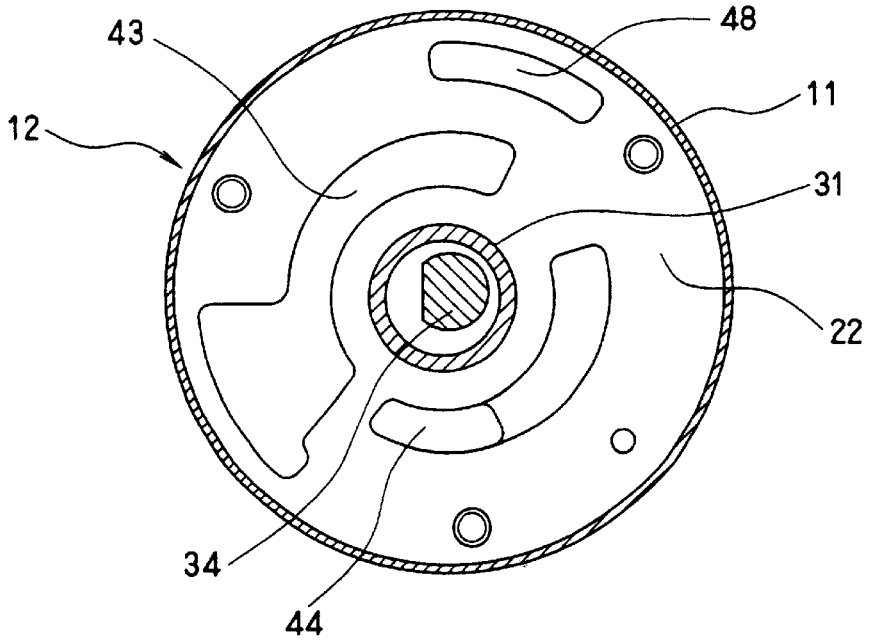
FIG. 5 is a cross-sectional view taken along line V—V in FIG. 2 (first embodiment)

The first embodiment of the present invention will be described with reference to FIGS. 1–6. Here, FIG. 1 is a longitudinal cross-sectional view showing a pump portion 12 of a fuel pump, FIG. 2 is a cross-sectional view taken along line II—II in FIG. 3, FIG. 3 is a bottom view of the fuel pump, FIG. 4 is a cross-sectional view taken along line IV—IV in FIG. 2, FIG. 5 is a cross-sectional view taken along line V—V in FIG. 2, and FIG. 6 is cross-sectional view taken along line VI—VI in FIG. 1.

The whole structure of a trochoid gear type fuel pump will be schematically described with reference to FIG. 1. A trochoid gear type pump portion 12 and a motor portion 13 are fitted in a cylindrical housing 11 of the fuel pump. A pump cover 14 covering the lower surface of the pump portion 12 is mechanically fixed to a lower end of the housing 11, and fuel in a fuel tank (not shown) is sucked from a fuel suction port 15 formed in this pump cover 14 into the pump portion 12. A motor cover 16 covering the motor portion 13 is mechanically fixed to an upper end of the housing 11, and a connector 17 for applying electric power to the motor portion 13 and a fuel discharge port 18 are provided to this motor cover 16. The fuel discharged from the pump portion 12 passes through a gap between an armature 33 and a magnet 38 of the motor portion 13 and is discharged from the fuel discharge port 18.

The structure of the trochoid gear type pump portion 12 will be described with reference to FIGS. 1–6. A casing of the pump portion 12 is constructed by closing opening portions at both upper and lower sides of a cylindrical casing 21 with a casing cover 22 and an inner cover 23. These respective parts, together with the pump cover 14, are fixed in the housing 11 by screwing or the like, and the inner cover 23 is interposed between the pump cover 14 and the cylindrical casing 21. An outer gear 24 and two inner gears 25 and 26 are housed in the casing of the pump portion 12. The outer gear 24, the inner gears 25 and 26, the inner cover 23, and the cylindrical casing 21 are made of material having wear resistance, for example, an iron-based sintered metal or the like. A sliding surface such as an inner surface (lower surface) of the casing cover 22 or an inner surface (upper surface) of the inner side cover 23 may be subjected to a surface treatment such as fluorine resin coating to reduce sliding resistance to the respective gears 24–26.

Figure 6:
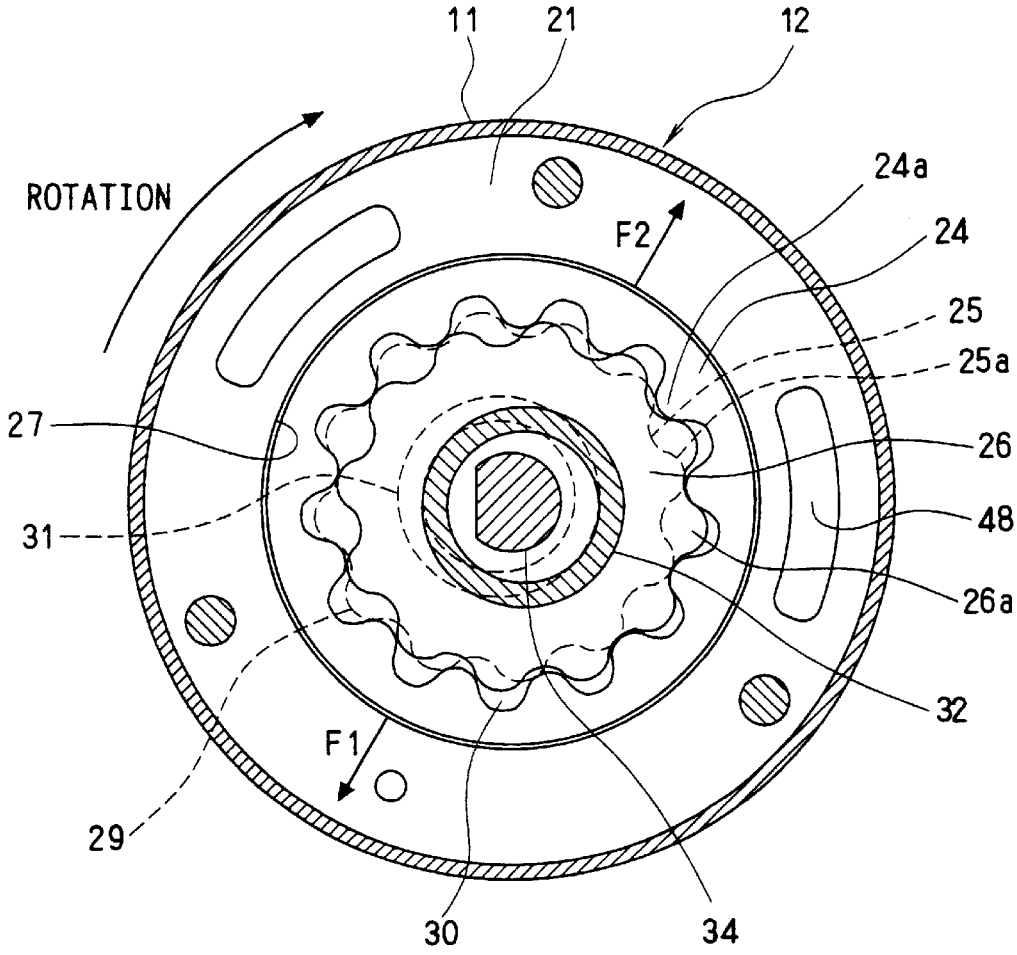
FIG. 6 is a cross-sectional view taken along line VI—VI in FIG. 1 (first embodiment)
Figure 7:
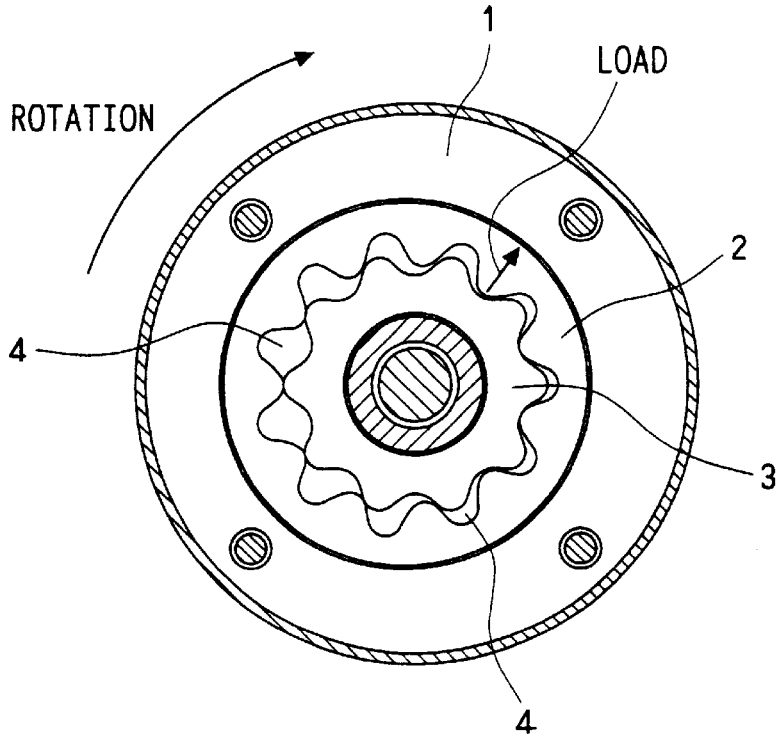
FIG. 7 PRIOR ART
FIG. 7 is a view for explaining a structure of a conventional trochoid gear type fuel pump (prior art)

As shown in FIG. 6, inner teeth 24*a* and outer teeth 25*a* and 26*a* are respectively formed at the inner peripheral side of the outer gear 24 and the outer peripheral sides of the inner gears 25 and 26, the number of teeth of the outer gear 24 is odd, and the number of teeth of the inner gears 25 and 26 is smaller than the number of teeth of the outer gear 24 by one to be even. The tooth thickness of the inner gears 25 and 26 is formed to be the same as the tooth thickness of the outer gear 24.

The outer gear 24 is rotatably fitted in a circular hole 27 formed in the cylindrical casing 21. The thickness dimension (dimension in an axial direction) of the outer gear 24 is smaller than the thickness dimension of the cylindrical casing 21 by a side clearance. A partition wall 28 (see FIGS. 1 and 2) halving a space in the outer gear 24 is formed at the inner peripheral side of the outer gear 24. This partition wall 28 may be formed integrally with the outer gear 24, or the partition wall 28 formed as a separate part is fixed to the inner peripheral center portion of the outer gear 24 by bonding or the like, or a partition wall as a separate part is interposed between two halved outer gears, and these three parts may be integrated by bonding or the like to form the outer gear 24.

At the inner peripheral side of the outer gear 24, the two inner gears 25 and 26 are overlapped with each other through the partition wall 28 and are eccentrically arranged, and eccentric directions of both the inner gears 25 and 26 with respect to the outer gear 24 are shifted from each other by 180° to the opposite side. By engagement or contact of teeth 24*a*, 25*a* and 26*a* of the respective gears 24, 25 and 26, a number of pump chambers 29 and 30 (see FIG. 6) are formed between those teeth. In this case, since the inner gears 25 and 26 are eccentric to the outer gear 24, amounts of engagement of the teeth 24*a*, 25*a* and 26*a* of the respective gears 24, 25 and 26 are continuously increased and decreased at the time of rotation, and an operation of continuously increasing and decreasing the volumes of the respective pump chambers 29 and 30 is repeated at a period of one rotation.

As shown in FIGS. 1 and 2, the inner gears 25, 26 are rotatably fitted in and supported by cylindrical bearings 31, 32 being eccentric to each other by 180° to the opposite side and press inserted to the almost center portion of the casing cover 22 and the pump cover 14, and a rotating shaft 34 of the armature 33 of the motor portion 13 is inserted in the inside of the cylindrical bearings 31 and 32. A D-cut portion of the rotating shaft 34 is inserted in a D-shaped connecting hole 35 formed at the center portion of the partition wall 28 of the outer gear 24, and the rotating shaft 34 of the motor portion 13 is connected with the outer gear 24 to be able to transmit a rotation.

Figure 9:
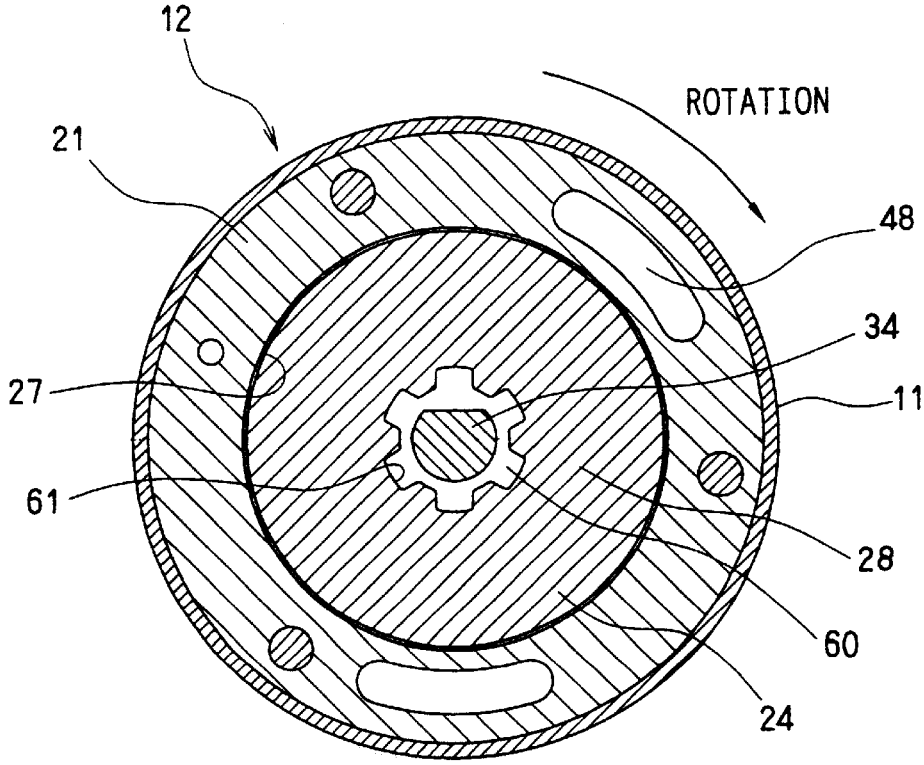
FIG. 9 is a cross-sectional view taken along line IX—IX in FIG. 8 (first embodiment)
Figure 8:
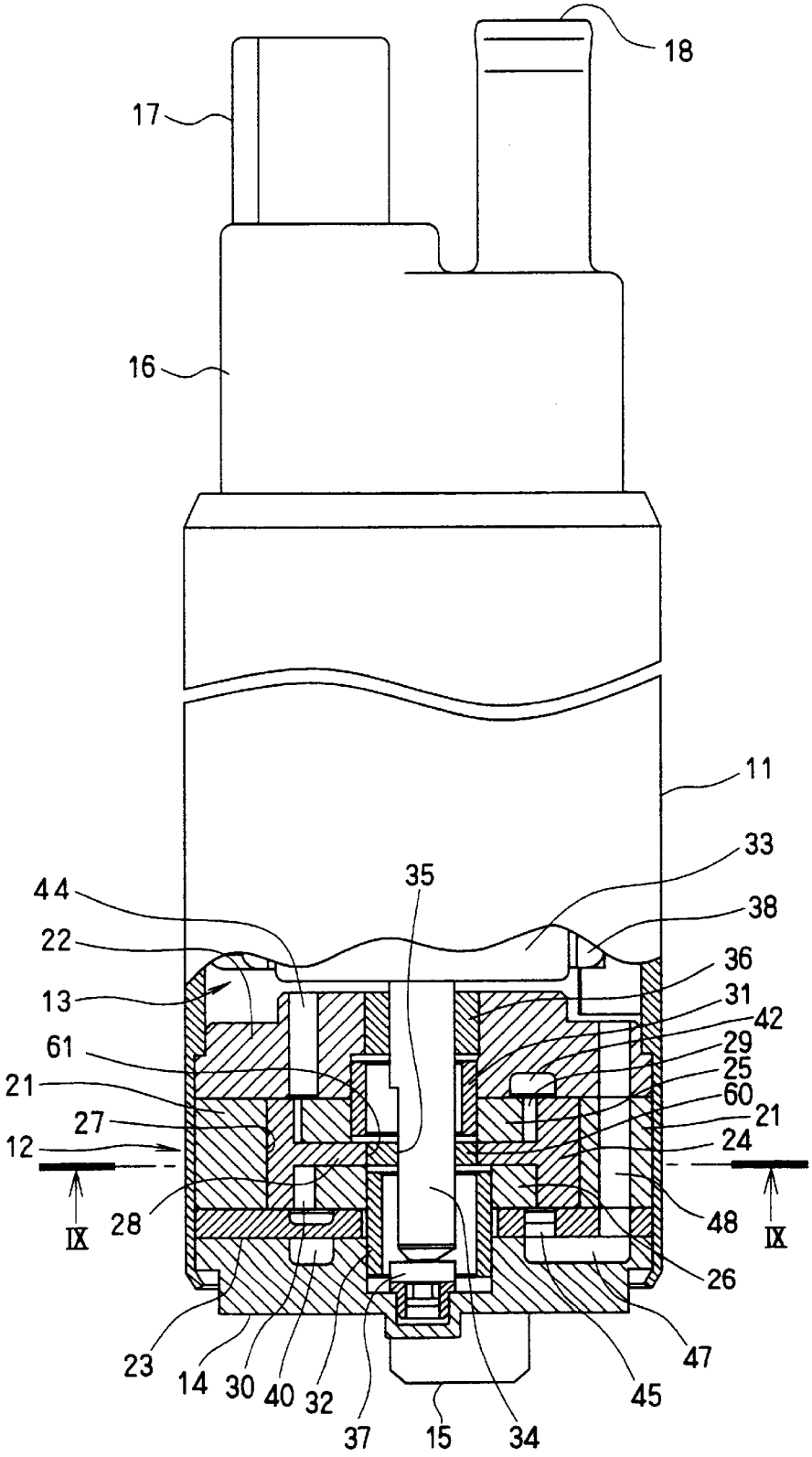
FIG. 8 is a longitudinal cross-sectional view showing a pump portion of a fuel pump according to a modified example (first embodiment)

The connecting structure of the rotating shaft 34 of the motor portion 13 and the outer gear 24 is not limited to the above structure, but as shown in FIGS. 8 and 9, a coupling 60 may be inserted to the D-cut portion of the rotating shaft 34 of the motor portion 13, and this coupling 60 may be inserted in a coupling-shaped connecting hole 61 formed at the center portion of the partition wall 28 of the outer gear 24 to make rotation driving.

When the outer gear 24 is rotated and driven by the motor portion 13, the inner gears 25, 26 engaging with this outer gear 24 rotate around the cylindrical bearings 31, 32 being eccentric from each other by 180° to the opposite side. Incidentally, the load of the armature 33 of the motor portion 13 in a radial direction is supported by inserting the rotating shaft 34 into a radial bearing 36 press inserted to the center portion of the casing cover 22, and the load of the armature 33 in a thrust direction is supported by a thrust bearing 37 press inserted to the inside of the center portion of the pump cover 14.

Fuel sucked from the fuel suction port 15 of the pump cover 14 branches toward two directions, and is sucked into the pump chambers 29, 30 of the inner gears 25, 26 at both the upper and lower sides. That is, half of the fuel sucked from the fuel suction port 15 is sucked into the pump chamber 30 of the lower inner gear 26 from a suction port 39 (see FIG. 2) formed in the inner cover 23. The remaining half of the fuel sucked from the fuel suction port 15 is sucked into the pump chamber 29 of the upper inner gear 25 through passages of a fuel introducing groove 40 (see FIGS. 2–4) of the inner surface of the pump cover 14→a through hole 41 (see FIG. 2) of the inner cover 23→a through flow path 42 (see FIG. 2) of the cylindrical casing 21→a fuel introducing groove 43 (see FIGS. 2 and 5) of the inner surface of the casing cover 22.

The fuel discharged from the pump chamber 30 of the lower inner gear 26 is discharged to the side of the motor portion 13 through passages of a discharge port 45 (see FIG. 1) of the inner cover 23→a discharge groove 47 (see FIGS. 1 and 4) of the inner surface of the pump cover 14→a discharge flow path 48 (see FIG. 1). The discharge flow path 48 is formed to pass through the inner side cover 23, the cylindrical casing 21, and the casing cover 22 in the vertical direction.

The fuel discharged from the pump chamber 29 of the upper inner gear 25 is discharged from the discharge port 44 (see FIGS. 1 and 5) of the casing cover 22 to the motor portion 13.

In the trochoid gear type fuel pump structured as described above, when the motor portion 13 is rotated and the outer gear 24 and the inner gears 25, 26 are rotated, the amounts of engagement of the teeth 24*a*, 25*a*, and 26*a* of the respective gears 24, 25 and 26 are continuously increased and decreased, and an operation of continuously increasing and decreasing the volumes of the respective pump chambers 29 and 30 formed between the respective teeth 24*a*, 25*a* and 26*a* is repeated at a period of one rotation. By this, in the pump chambers 29 and 30 in which the volumes are increased, the fuel is transferred while being sucked, and in the pump chambers 29, 30 in which the volumes are decreased, the transferred fuel is discharged from the discharge ports 44, 45.

Here, in the discharge region where the volumes of the pump chambers 29, 30 are decreased, the fuel in the pump chambers 29, 30 is pressurized and the pressure of the fuel (fuel pressure) is raised, so that the load in the outer diameter direction is applied to the outer gear 24 by the rise of the fuel pressure. Since such load in the outer diameter direction by the rise of the fuel pressure is not produced in the suction region where the fuel pressure of the pump chambers 29, 30 is lowered, the load in the outer diameter direction to the outer gear 24 affects only the discharge region (side of the discharge ports 44, 45) where the fuel pressure of the pump chambers 29, 30 is raised.

In the present embodiment, since the eccentric directions of the two inner gears 25, 26 arranged at the inner peripheral side of the outer gear 24 are shifted from each other by 180° to the opposite side, in the two inner gears 25, 26, fuel pressure rising sides (discharge ports 44, 45) are shifted from each other by 180° to the opposite side. By this, loads F1 and F2 (see FIG. 6) in the outer diameter direction by the rise of the fuel pressure affect the one outer gear 24 from the two inner gears 25, 26 oppositely to each other by 180°, so that the loads F1 and F2 affecting the outer gear 24 in the outer diameter direction are balanced, and an eccentric load hardly affects the outer gear 24. Thus, there does not occur such a state that the outer gear 24 is severely pressed to the inner peripheral surface of the cylindrical casing 21 by the fuel pressure, the sliding resistance (friction loss) of the outer gear 24 to the cylindrical casing 21 becomes smaller than the prior art, and by that, the load of the motor portion 13 becomes small and consumed electric power is reduced. Further, since the fuel is sucked and discharged by the two inner gears 25, 26 in the outer gear 24, in cooperation with the foregoing sliding resistance reduction effect, fuel discharge performance can be effectively raised.

In general, in the trochoid gear type fuel pump, although the number of teeth of the inner gears 25, 26 are made smaller than the number of teeth of the outer gear 24 by one, when the number of teeth of the outer gear 24 at the driving side is even (the number of teeth of the inner gears 25, 26 at the driven side is odd), rotation phases of the two inner gears 25, 26 at the driven side coincide with each other. In this state, phases of discharge pressure pulsation waves of the two inner gears 25, 26 at the driven side coincide with each other, and when the discharge pressure pulsation wave of the one inner gear has a top (bottom), the other also has a top (bottom). Thus, the discharge pressure pulsations of the two inner gears 25, 26 amplify each other, and noise and vibration by the discharge pressure pulsation becomes large.

According to the present first embodiment, the number of teeth of the outer gear 24 at the driving side is made odd, and the number of teeth of the inner gears 25, 26 at the driven side is made smaller than the number of teeth of the outer gear 24 at the driving side by one to be even. By this, the rotation phases of the two inner gears 25, 26 at the driven side are shifted from each other by a half pitch, and the phases of the discharge pressure pulsation waves of the two inner gears 25, 26 at the driven side are shifted by the half period of the pulsation wave. As a result, when the discharge pressure pulsation wave of the one inner gear has a top, the other has a bottom, and the discharge pressure pulsations of the two inner gears 25, 26 interfere with each other to attenuate, and by that, the discharge pressure pulsation is greatly reduced, and noise and vibration due to the discharge pressure pulsation is greatly reduced. By this, conventional measures against noise (discharge pressure pulsation reducing device, sound shielding member, etc.) become unnecessary, and low noise and low vibration are realized at low cost.

Here, when the outer gear is produced, a partition wall as a separate part is previously interposed between two halved outer gears, and these three parts may be integrated by bonding or the like. In this case, the integration may be made by interposing the partition wall in the state where the one divided outer gear is shifted by a half pitch from the other divided outer gear. In this case, contrary to the above embodiment, the number of teeth of the outer gear is made even, and the number of teeth of the inner gear is made smaller than the number of teeth of the outer gear by one to be odd. By this, similarly to the embodiment, the phases of the discharge pressure pulsation waves of the two inner gears are shifted from each other by the half period of the pulsation wave and the pressure pulsation is greatly reduced.

(Second Embodiment)

In the pump portion 12 in the first embodiment, the two inner gears 25, 26 are arranged at the inner peripheral side of the one outer gear 24 in the state where they are overlapped with each other through the partition wall 28 so that two pumps are constructed, and the outer gear 24 of the two pumps is integrally formed. In a pump portion 62 of the second embodiment shown in FIGS. 10–14, outer gears 67, 68 of two pumps are formed as separate bodies, and an arrangement is made such that two pumps in each of which one inner gear 69, 70 is arranged at the inner peripheral side of each of the outer gears 67, 68, are overlapped with each other.

Figure 10:
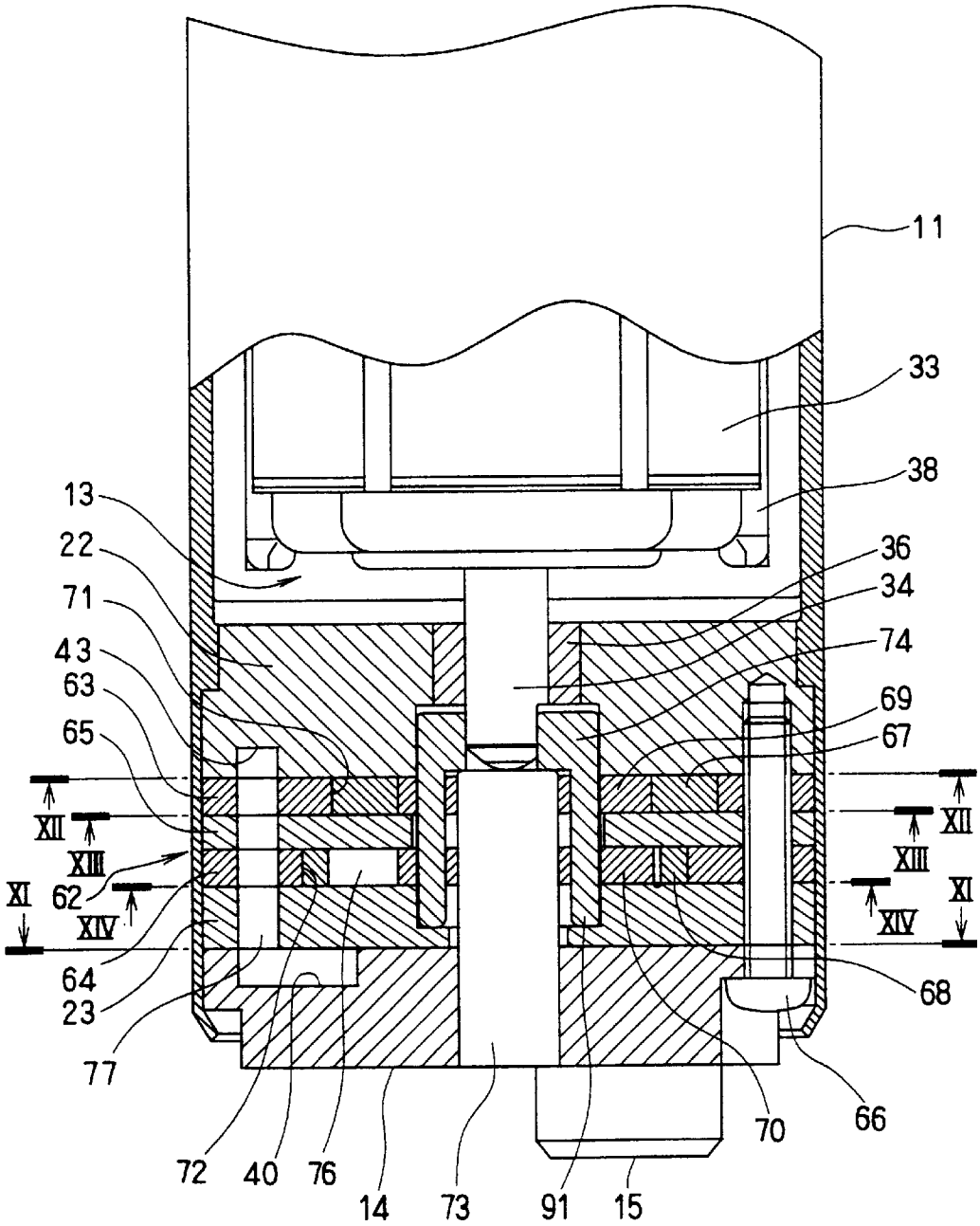
FIG. 10 is longitudinal cross-sectional view showing a pump portion of a fuel pump (second embodiment)
Figure 11:
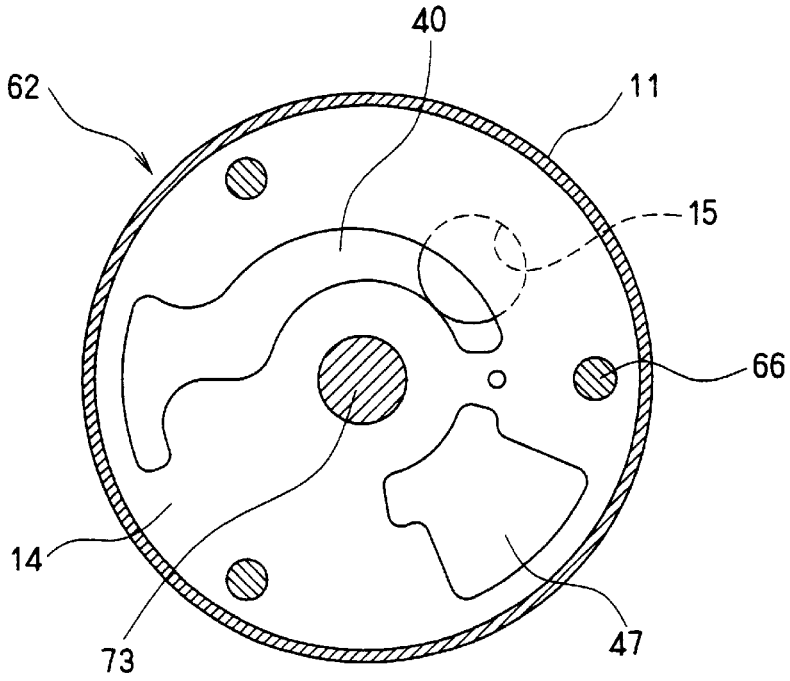
FIG. 11 is a cross-sectional view taken along line XI—XI in FIG. 10 (second embodiment)
Figure 12:
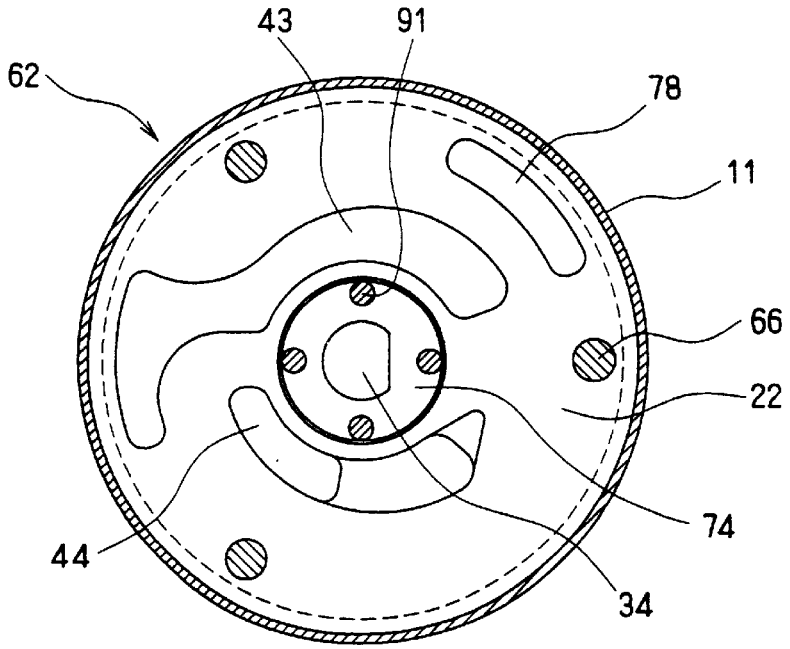
FIG. 12 is a cross-sectional view taken along line XII—XII in FIG. 10 (second embodiment)
Figure 13:
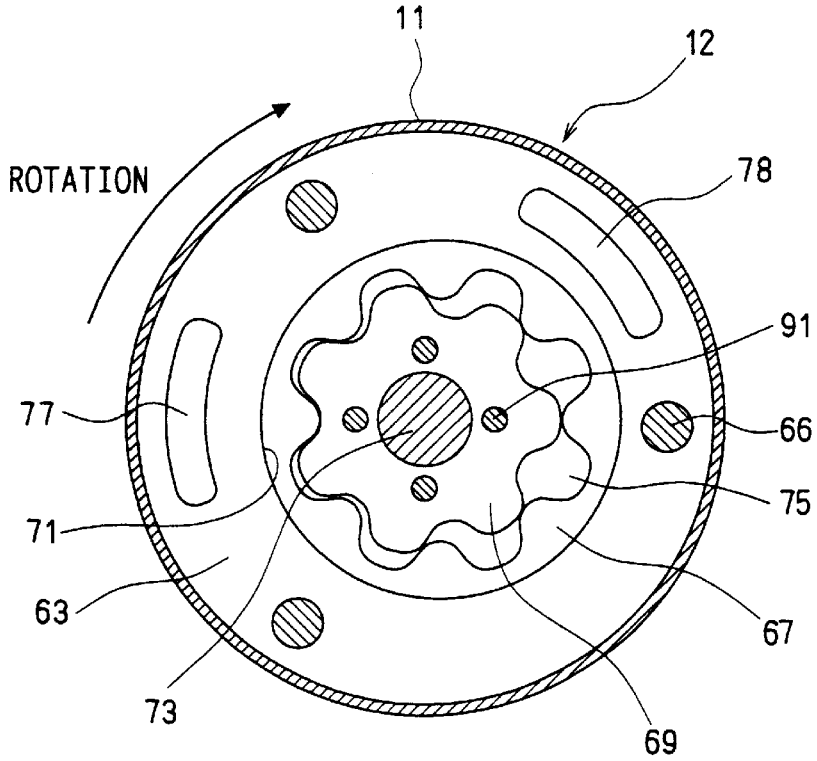
FIG. 13 is a cross-sectional view taken along line XIII—XIII in FIG. 10 (second embodiment)
Figure 14:
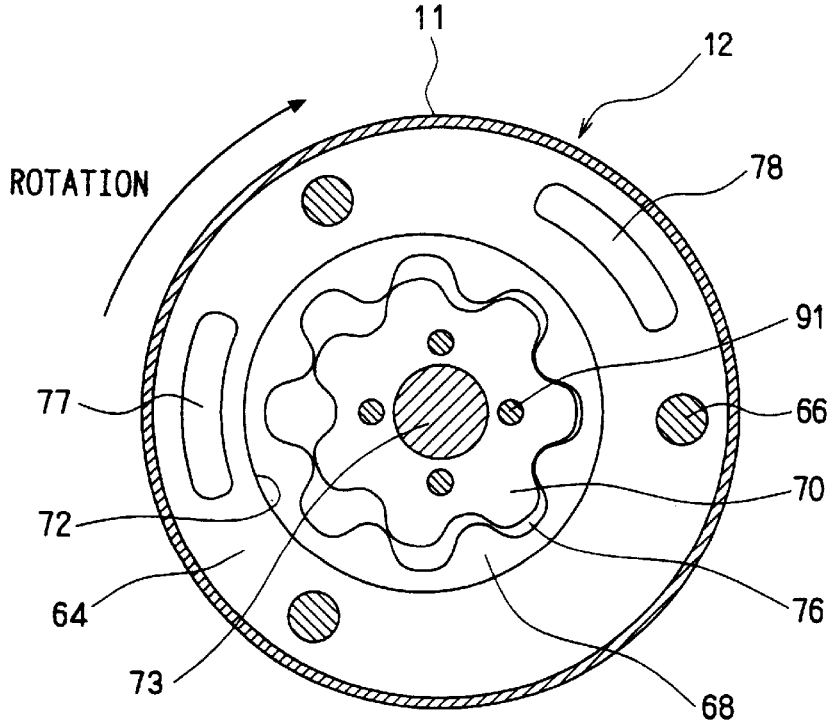
FIG. 14 is a cross-sectional view taken along line XIV—XIV in FIG. 10 (second embodiment)

Hereinafter, the structure of this pump portion will be specifically described. FIG. 10 is a longitudinal cross-sectional view showing the pump portion 62 of a fuel pump, FIG. 11 is a cross-sectional view taken along line XI—XI in FIG. 10, FIG. 12 is a cross-sectional view taken along line XII—XII in FIG. 10, FIG. 13 is a cross-sectional view taken along line XIII—XIII in FIG. 10, and FIG. 14 is a cross-sectional view taken along line XIV—XIV in FIG. 10. The substantially same portions as the first embodiment are designated by the same numerals and the explanation is simplified.

In the second embodiment, as shown in FIG. 10, a casing of the pump portion 62 is constructed such that two cylindrical casings 63 and 64 are overlapped with each other through an intermediate plate 65, and opening portions at both upper and lower sides are closed by a casing cover 22 and an inner side cover 23. These respective parts, together with a pump cover 14, are screwed up and fixed in a housing 11 by a screw 66. The pair of the outer gear 67 and the inner gear 69 constituting a first pump are housed in a space at the upper side of the intermediate plate 65 in the casing of this pump portion 62, and the pair of the outer gear 68 and the inner gear 70 constituting a second pump are housed in a space at the lower side of the intermediate plate 65.

As shown in FIGS. 13 and 14, circular holes 71, 72 being eccentric from each other by 180° to the opposite side are formed in the respective cylindrical casings 63, 64, and the outer gears 67, 68 are rotatably fitted in the respective circular holes 71, 72. The inner gears 69, 70 are respectively eccentrically arranged at the inner peripheral side of the respective outer gears 67, 68. In the second embodiment, the two inner gears 69, 70 are arranged to be rotated and driven coaxially and at the same phase, and the eccentric directions of the respective outer gears 67, 68 with respect to the respective inner gears 69, 70 are shifted from each other by 180° to the opposite side. Besides, the number of teeth of the inner gears 69, 70 at the driving side rotated and driven by a motor portion 13 is made odd, and the number of teeth of the outer gears 67, 68 at the driven side is made larger than the number of teeth of the inner gears 69, 70 at the driving side by one to be even.

As shown in FIG. 10, the respective inner gears 69, 70 are rotatably fitted in and supported by a shaft 73 press inserted to the center portion of the pump cover 14, and the respective inner gears 69 and 70 and a rotating shaft 34 of the motor portion 13 are connected through a coupling 74 to be able to transmit a rotation. A D-cut portion of the rotating shaft 34 of the motor portion 13 is inserted in a D-shaped connecting hole formed in an upper portion of the coupling 74, so that the coupling 74 is connected with the rotating shaft 34. A plurality of connecting pins 91 formed downward at the lower portion of the coupling 74 are inserted in connecting holes of the inner gears 69, 70, so that the coupling 74 is connected with the inner gears 69, 70. When the respective inner gears 69, 70 are rotated and driven by the motor portion 13, the outer gears 67, 68 engaging with the respective inner gears 69, 70 are rotated in the state where they are eccentric from each other by 180° to the opposite side. A load of an armature 33 of the motor portion 13 is supported by the upper surface of the shaft 73.

Similarly to the first embodiment, half of fuel sucked from a fuel suction port 15 of the pump cover 14 is sucked from a suction port 39 of the inner side cover 23 into a pump chamber 76 of the lower inner gear 70. The remaining half fuel sucked from the fuel suction port 15 is sucked into a pump chamber 75 of the upper inner gear 69 through passages of a fuel introducing groove 40 (see FIGS. 10 and 11) of the inner surface of the pump cover 14 a through flow path 77 (see FIGS. 10, 13 and 14) a fuel introducing groove 43 (see FIGS. 10 and 12) of the inner surface of the casing cover 22. The through flow path 77 is formed to pass through the inner side cover 23, the cylindrical casing 64, the intermediate plate 65 and the cylindrical casing cover 63 in the vertical direction.

The fuel discharged from the pump chamber 76 of the lower inner gear 70 is discharged toward the motor portion 13 through passages of a discharge port 45 of the inner side cover 23→a discharging groove 47 (see FIG. 11) of the inner surface of the pump cover 14→a discharge flow path 78 (see FIGS. 12–14). The discharge flow path 78 is formed to pass through the inner side cover 23, the cylindrical casing 64, the intermediate plate 65, the cylindrical casing 63, and the casing cover 22 in the vertical direction. The fuel discharged from the pump chamber 75 of the upper inner gear 69 is discharged from a discharge port 44 (see FIG. 12) of the casing cover 22 to the side of the motor portion 13.

In the second embodiment described above, the number of teeth of the inner gears 69, 70 rotated and driven by the motor portion 13 at the same phase is made odd, and the number of teeth of the outer gears 67, 68 at the driven side is made larger than the number of teeth of the inner gears 69, 70 by one to be even. Thus, rotation phases of the outer gears 67, 68 at the driven side are shifted by a half pitch, and similarly to the first embodiment, the discharge pressure pulsations of the two pumps interfere with each other to attenuate, so that the discharge pressure pulsation is greatly reduced, and the noise and vibration due to the discharge pressure pulsation is greatly reduced. By this, the conventional noise measures (discharge pressure pulsation reducing device, sound shielding member, etc.) become unnecessary, and low noise and low vibration can be realized at low cost.

The one inner gear may be made to rotate while being sifted from the other inner gear by a half pitch, and in this case, contrary to the second embodiment, the number of teeth of the inner gears 69, 70 at the driving side is made even, and the number of teeth of the outer gears 67, 68 at the driven side is made larger than the number of teeth of the inner gears 69, 70 by one to be odd. By this, similarly to the second embodiment, the phases of the discharge pressure pulsation waves of the two pumps are shifted from each other by a half wavelength (half period) of the pulsation wave, and the discharge pressure pulsation is greatly reduced.

Further, in the second embodiment, since eccentric directions of the outer gears 67, 68 of the upper and lower pumps are shifted from each other by 180° to the other side, fuel rising sides are shifted from each other by 180° to the opposite side between both the pumps. Thus, loads in the outer diameter direction affect both the pumps oppositely to each other by 180°, so that the loads affecting in the outer diameter direction can be balanced in the whole of the fuel pump, and the vibration of the fuel pump can be reduced.

Further, in the second embodiment, since the intermediate plate 65 fixed by being interposed between the two cylindrical casings 63, 64 are made to intervene between the upper and lower pumps, the intermediate plate 65 can prevent the outer gears 67, 68 from tilting in the prizing direction by the load (fuel pressure) in the outer diameter direction affecting the upper and lower pumps (outer gears 67, 68), and can prevent an increase in rotation sliding resistance by tilting of the outer gears 67, 68.

Besides, in the second embodiment, even when the tooth thicknesses of the outer gears 67, 68 and the inner gears 69, 70 are changed, that is absorbed by the change of thickness dimension of the inner side cover 23, and the whole length of the pump can be kept constant, so that the pump discharge capacity can be changed by changing the tooth thickness and without changing the whole pump length. Thus, fuel pumps of a common size can deal with various engines having different required discharge capacities, and attachment parts (bracket, etc.) of the fuel pump can be made common.

In the second embodiment, the two inner gears 69, 70 are arranged coaxially and the eccentric directions of the two outer gears 67, 68 with respect to the inner gears 69, 70 are shifted from each other by 180° to the opposite side. However, the two outer gears may be arranged coaxially, and the eccentric directions of the two inner gears with respect to the outer gear may be shifted from each other by 180° to the opposite side. In this case, such a structure is adopted that side covers are integrated with the sides of the respective outer gears, and the side covers are connected with the rotating shaft of the motor portion, so that the two outer gears, together with the side cover, are rotated and driven by the motor portion at the same phase. The number of teeth of the outer gears at the driving side is made odd, and the number of teeth of the inner gears at the driven side is made smaller than the number of teeth of the outer gears by one to be even. Besides, the one outer gear may be rotated while being shifted from the other outer gear by a half pitch, and in this case, the number of teeth of the outer gears is made even, and the number of teeth of the inner gears is made smaller than the number of teeth of the outer gears by one to be odd.

(Third Embodiment)

Figure 15:
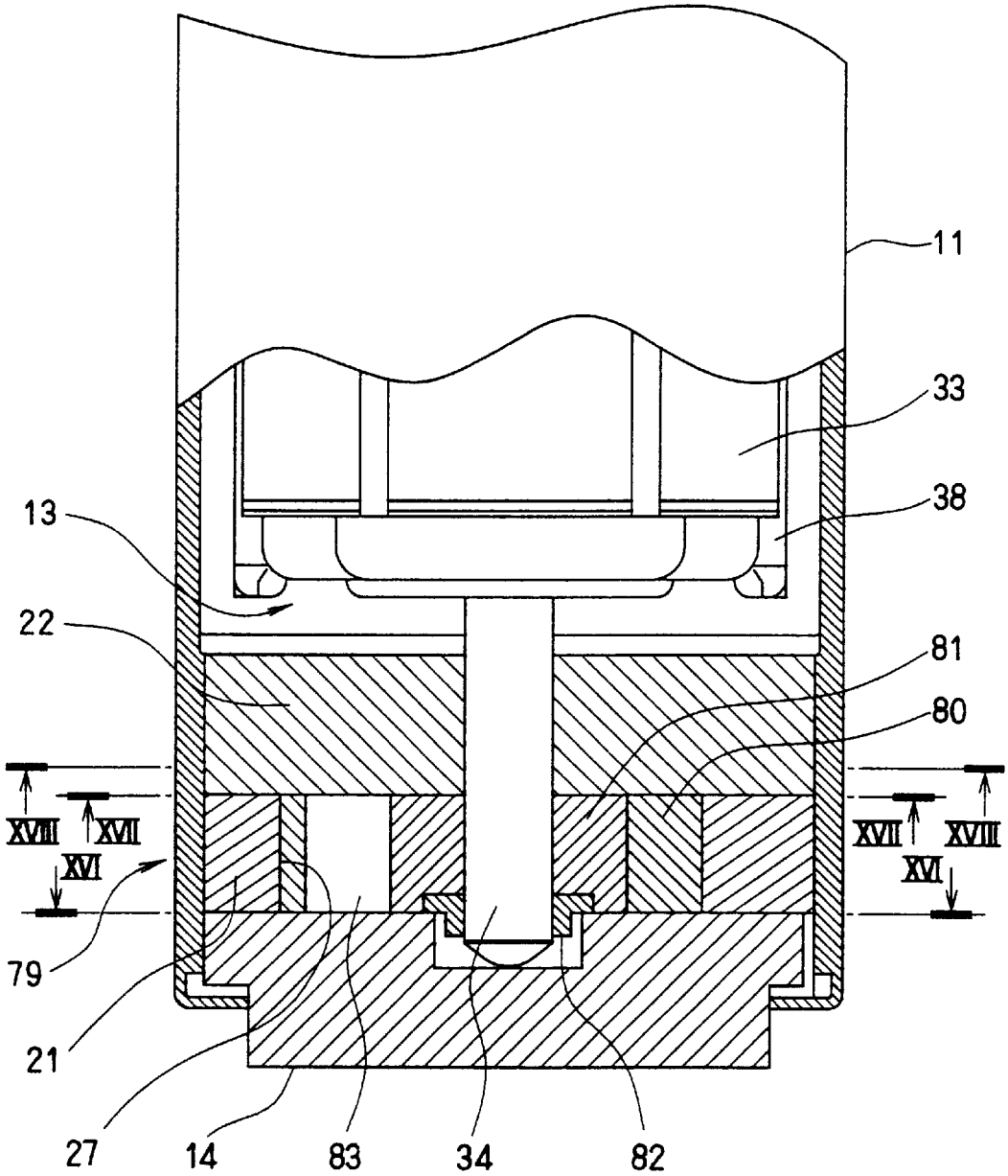
FIG. 15 is a longitudinal cross-sectional view showing a pump portion of a fuel pump (third embodiment)
Figure 16:
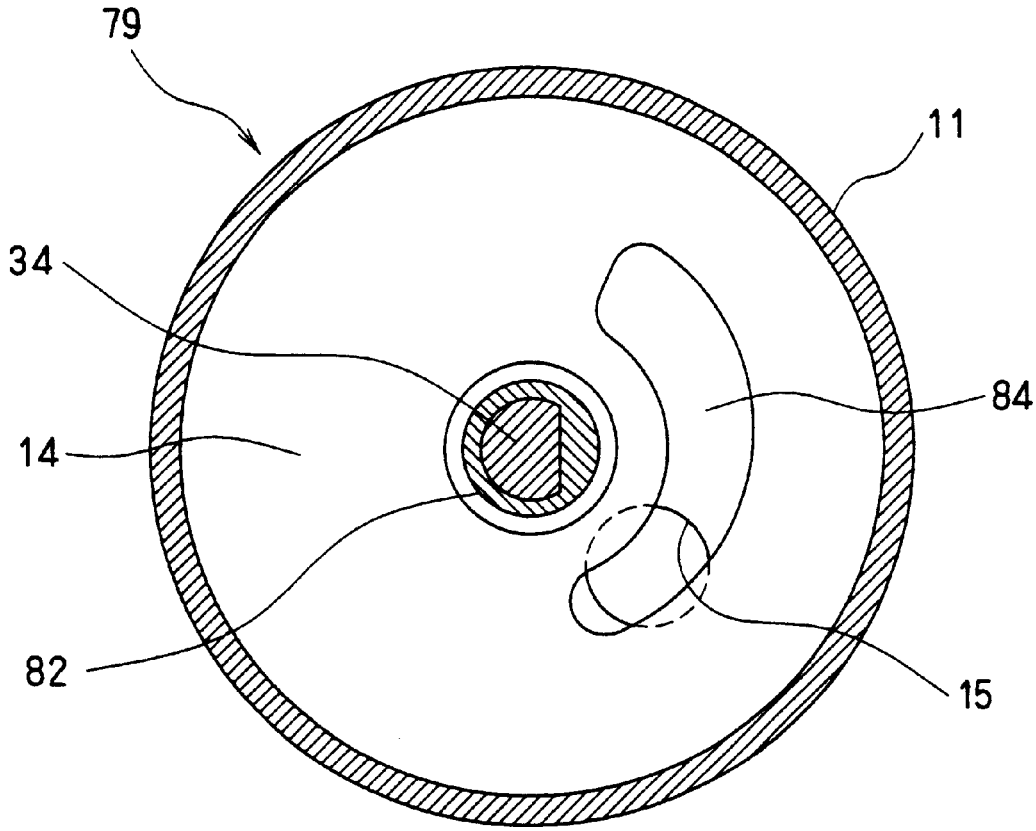
FIG. 16 is a cross-sectional view taken along line XVI—XVI in FIG. 15 (third embodiment)
Figure 18:
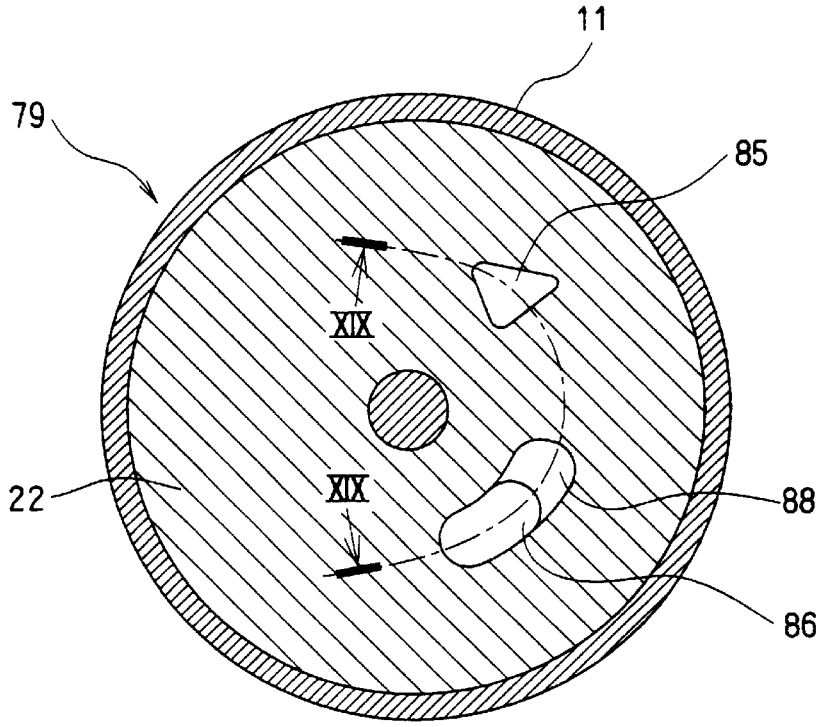
FIG. 18 is cross-sectional view taken along line XVIII—XVIII in FIG. 15 (third embodiment)
Figure 19:
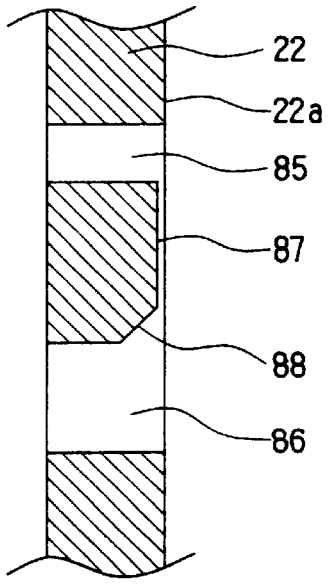
FIG. 19 is a cross-sectional view of a casing cover indicated along line XIX—XIX in FIG. 18 (third embodiment)

The third embodiment of the present invention will be described with reference to FIGS. 15–19. Here, FIG. 15 is a longitudinal cross-sectional view showing a pump portion 79 of a fuel pump, FIG. 16 is a cross-sectional view taken along line XVI—XVI in FIG. 15, FIG. 17 is a cross-sectional view taken along line XVII—XVII in FIG. 15, FIG. 18 is a cross-sectional view taken along line XVIII—XVIII in FIG. 15, and FIG. 19 is a cross-sectional view showing a casing cover 22 indicated along line XIX—XIX in FIG. 18. The substantially same portions as the first embodiment are designated by the same numerals and the explanation is simplified.

In the third embodiment, as shown in FIG. 15, a casing of the pump portion 79 is constructed by closing opening portions of a cylindrical casing 21 at both upper and lower sides with the casing cover 22 and a pump cover 14, and a pair of outer gear 80 and inner gear 81 are housed in the casing of this pump portion 79. The outer gear 80 is rotatably fitted in a circular hole 27 of the cylindrical casing 21, and the inner gear 81 is fitted and supported by a rotating shaft 34 of a motor portion 13. The rotating shaft 34 of the motor portion 13 and the inner gear 81 are connected to each other through a coupling 82 to be able to transmit a rotation, and when the inner gear 81 is rotated and driven by the motor portion 13, the outer gear 80 engaged with this inner gear 81 is rotated.

As shown in FIG. 16, a suction port 84 is formed in the pump cover 14 to communicate with a plurality of pump chambers 83 in which volumes are enlarged, and fuel sucked from a fuel suction port 15 is sucked from the suction port 84 into the pump chamber 83.

As shown in FIGS. 17–19, two discharge ports 85, 86 are formed in the casing cover 22 to communicate with the pump chambers 83 in which volumes are decreased, and the fuel discharged from the pump chambers 83 is discharged from the respective discharge ports 85, 86 to the side of the motor portion 13. The respective discharge ports 85, 86 are provided as explained below, so that the phases of discharge pressure pulsations are shifted by an almost half wavelength and are merged while interfering with each other.

Figure 17A:
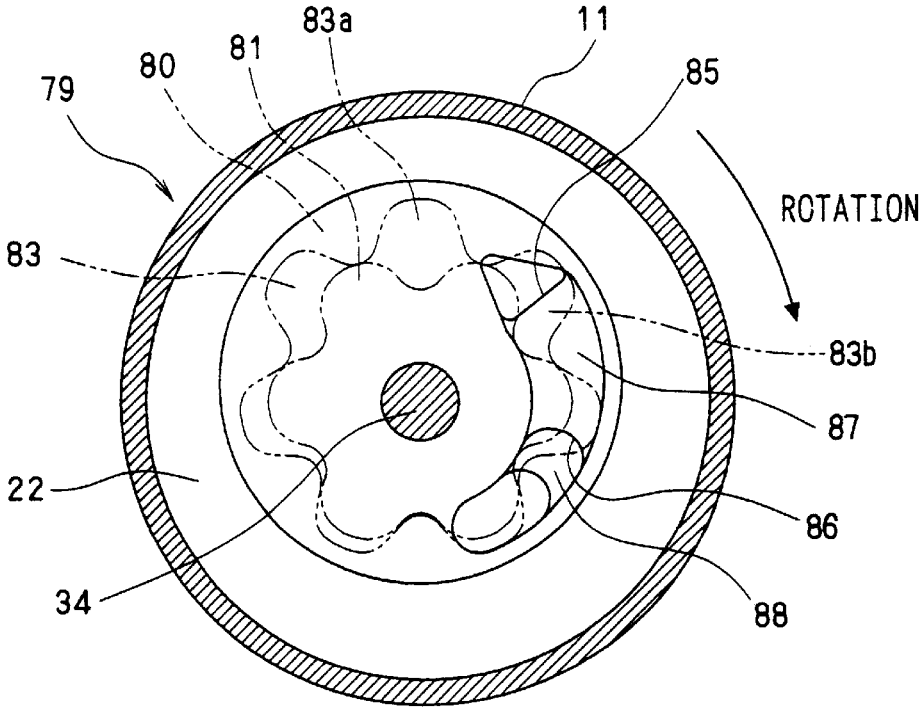
FIGS. 17A and 17B are cross-views for explaining formation positions of discharge ports and taken along line XVII—XVII in FIG. 15, which shows states of gear rotation positions shifted from each other by a half pitch (third embodiment)
Figure 17B:
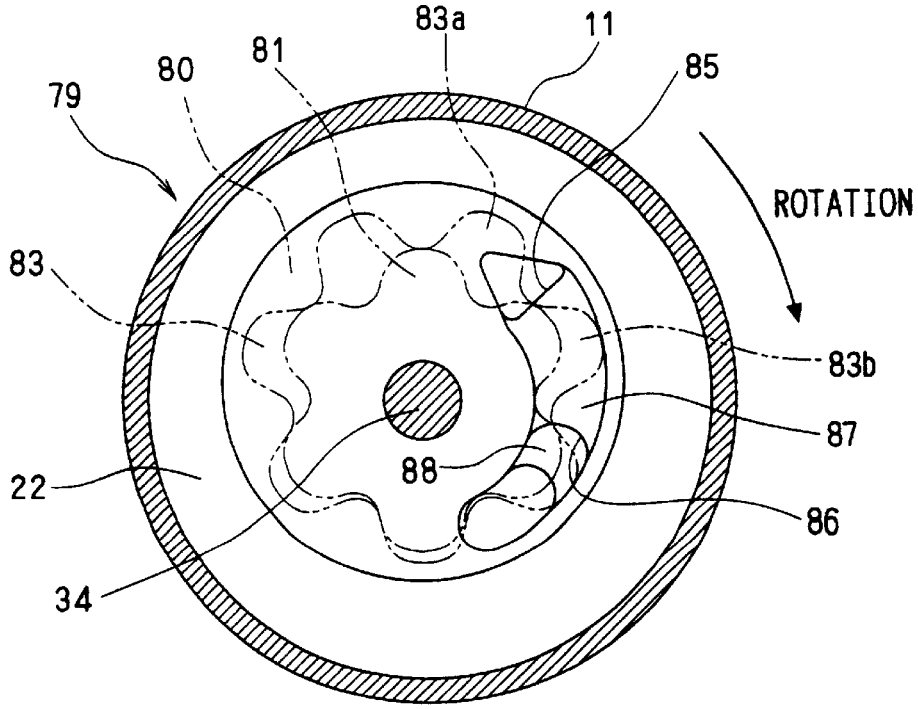

FIG. 17A shows rotation positions of the inner gear 81 and the outer gear 80 when the volume of a pump chamber 83*a* in a boundary region between a suction region and a discharge region becomes maximum, and FIG. 17B shows a state when the inner gear 81 and the outer gear 80 make a rotation of a half pitch from the position of FIG. 17A. As shown in FIG. 17A, the first discharge port 85 is formed over an almost half pitch from a partition position between the pump chamber 83*a* of the maximum volume and an adjacent pump chamber 83*b*. That is, as shown in FIG. 17A, a start position of the upstream side discharge port 85 is located in a vicinity of an end of the pump chamber 83*a* of which volume becomes maximum. As shown in FIG. 17B, an end position of the upstream side discharge port 85 is located in a vicinity of an end of a pump chamber 83*a* which is formed when both gears 80, 81 move by half phase.

The second discharge port 86 is formed at a position separate from the first discharge port 85 by about 1.5 pitches in the rotation direction. That is, as shown in FIG. 17B, a start position of the downstream side discharge port 86 is located in a vicinity of an end of the pump chamber 83*b* next to the end position of the upstream side discharge port 85. The second discharge port 86 starts to open in the pump chamber 83*b* adjacent to the pump chamber 83*a* having the maximum volume with a delay of a half pitch from the time when the first discharge port 85 starts to open in the pump chamber 83*a* having the maximum volume. By this, remaining fuel in the pump chamber 83*b* adjacent to the pump chamber 83*a* having the maximum volume starts to be discharged from the second discharge port 86 with a delay of a half pitch from the time when part of fuel in the pump chamber 83*a* having the maximum volume shown in FIG. 17A starts to be discharged from the first discharge port 85. As a result, vertical movement timings of the two discharge ports 85, 86 are shifted by a half pitch to produce the state where the phases of the discharge pressure pulsations of the two discharge ports 85, 86 are shifted by an almost half wavelength.

The interval between the two discharge ports 85, 86 may be determined in accordance with the number of teeth of the inner gear 81 and the outer gear 80, and even when the number of teeth is changed, the second discharge port has only to be formed at a position where one pump chamber (inter-tooth chamber) can be formed after the first discharge port.

Further, as shown in FIG. 19, a recess 87 having a predetermined step (for example, about 0.2 mm) with respect to a lower surface (sliding surface) 22*a* of the casing cover 22 is formed between the discharge ports 85, 86. Further, a taper portion 88 extending toward the pump chamber 83 is formed at an inlet portion of the discharge port 86.

In the third embodiment described above, the discharge ports 85, 86 through which the fuel in the pump chamber 83 is discharged are formed so that the phases of the discharge pressure pulsations are shifted by the almost half wavelength and are merged while interfering with each other. Thus, the discharge pressure pulsations of the two discharge ports 85, 86 interfere with each other to attenuate, so that the discharge pressure pulsation is greatly reduced, and the noise and vibration due to the discharge pressure pulsation is greatly reduced. By this, as compared with the case where two pumps are provided to reduce the discharge pressure pulsation as in the first and second embodiments, the number of parts is reduced, the structure can be simplified, and reduction in weight and reduction in cost can be realized while low noise and low vibration is realized.

(Fourth Embodiment)

Figure 20:
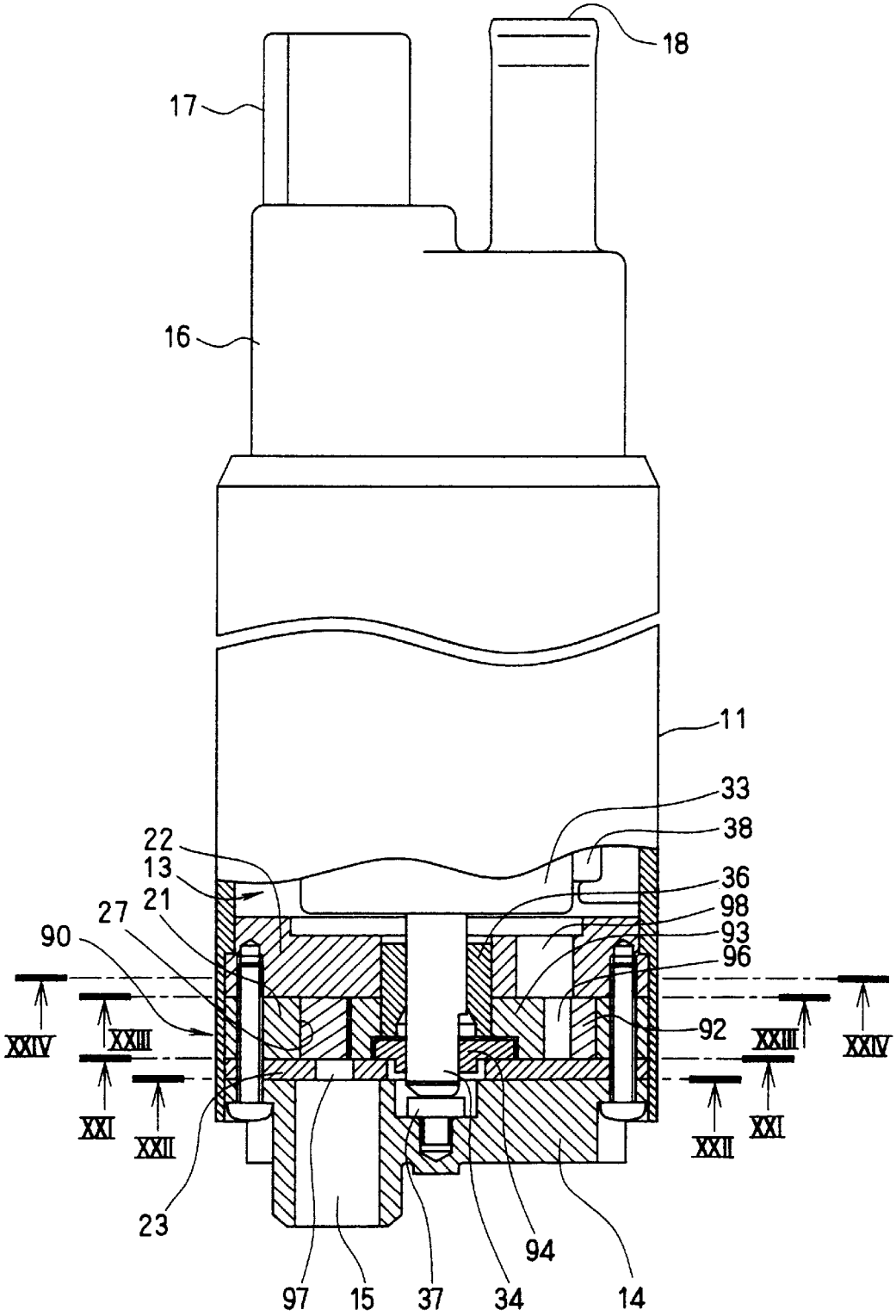
FIG. 20 is a longitudinal cross-sectional view showing a pump portion of a fuel pump (fourth embodiment)
Figure 21:
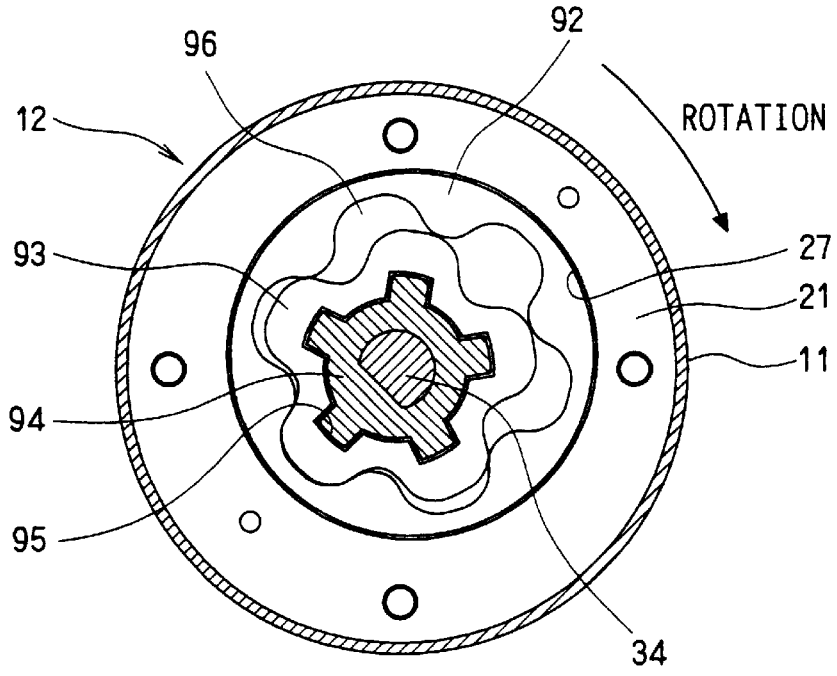
FIG. 21 is a cross-sectional view taken along line XXI—XXI in FIG. 20 (fourth embodiment)
Figure 22:
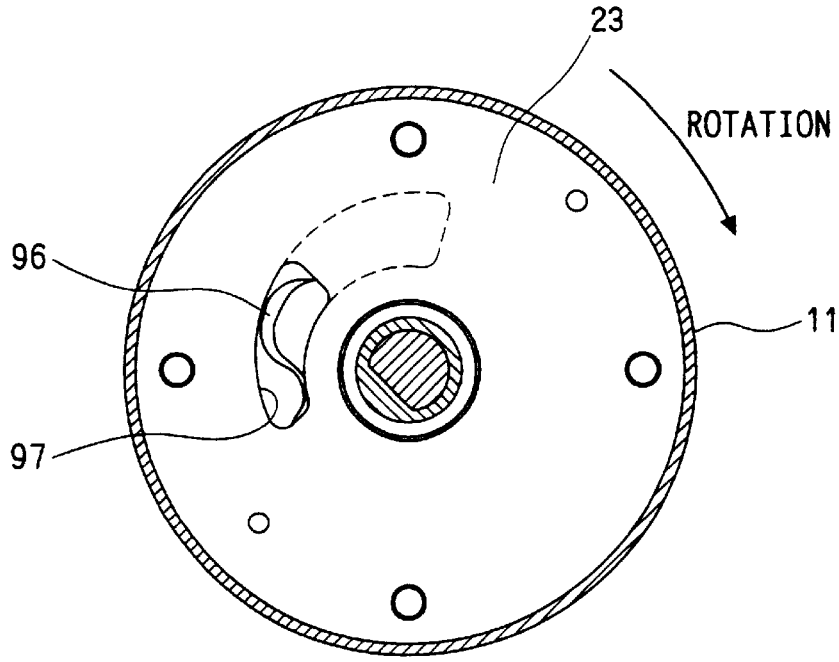
FIG. 22 is a cross-sectional view taken along line XXII—XXII in FIG. 20 (fourth embodiment)
Figure 23:
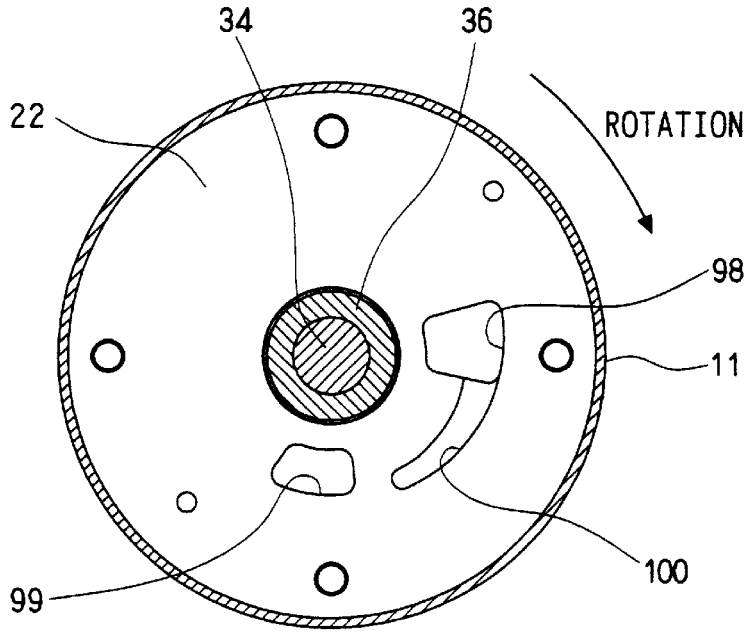
FIG. 23 is a cross-sectional view taken along line XXIII—XXIII in FIG. 20 (fourth embodiment)
Figure 24:
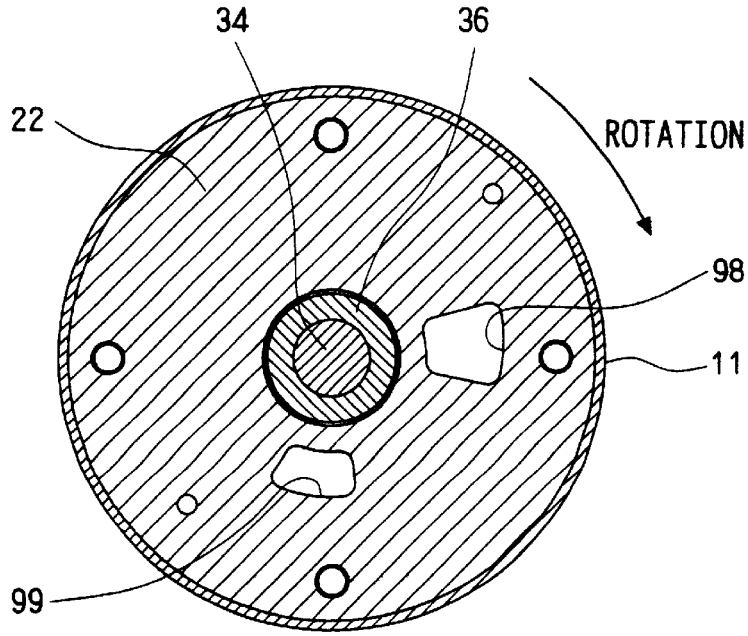
FIG. 24 is a cross-sectional view taken along line XXIV—XXIV in FIG. 20 (fourth embodiment)

The fourth embodiment of the present invention will be described with reference to FIGS. 20–25. Here, FIG. 20 is a longitudinal cross-sectional view showing a pump portion 90 of a fuel pump, FIG. 21 is a cross-sectional view taken along line XXI—XXI in FIG. 20, FIG. 22 is a cross-sectional view taken along line XXII—XXII in FIG. 20, FIG. 23 is a cross-sectional view taken along line XXIII—XXIII in FIG. 20, FIG. 24 is a cross-sectional view taken along line XXIV—XXIV in FIG. 20, and FIG. 25 is a view for explaining formation positions of discharge ports 98, 99 and a communicating groove portion 100. The substantially same portions as in the first embodiment are designated by the same numerals and the explanation is simplified.

In the fourth embodiment, as shown in FIG. 20, a casing of the pump portion 90 is constructed by closing opening portions of a cylindrical casing 21 at both upper and lower sides with a casing cover 22 and an inner side cover 23, and a pair of outer gear 92 and inner gear 93 are housed in the casing of the pump chamber 90. The inner gear 93 is rotatably fitted in and supported by a radial bearing 36 press inserted into the casing cover 22, and a rotating shaft 34 of a motor portion 13 is inserted inside of the radial bearing 36. In the fourth embodiment, as shown in FIG. 21, the number of teeth of the outer gear 92 is six, and the number of teeth of the inner gear 93 is five.

As shown in FIG. 21, a D-cut portion of the rotating shaft 34 is inserted in a coupling 94, and this coupling 94 is inserted in a connecting hole 95 of a coupling shape formed at the center portion of the inner gear 93, so that the rotating shaft 34 of the motor portion 13 and the inner gear 93 are connected with each other through the coupling 94 to be able to transmit a rotation.

Further, as shown in FIG. 22, a suction port 97 is formed in the inner side cover 23, and fuel sucked from a fuel suction port 15 is sucked from the suction port 97 into pump chambers 96.

As shown in FIGS. 23–25, the two discharge ports 98, 99 are formed in the casing cover 22 to communicate with the pump chambers 96 in which the volumes are decreased, and the fuel discharged from the pump chambers 96 is discharged from the respective discharge ports 98, 99 toward the motor portion 13.

Figure 25B:
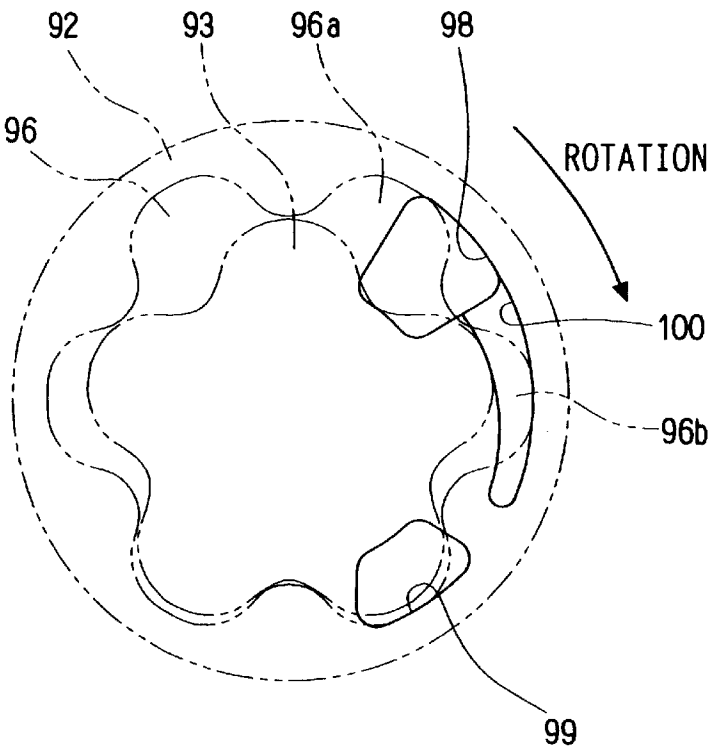
FIGS. 25A and 25B are views for explaining formation positions of discharge ports and a communicating groove portion, and showing states of gear rotation positions shifted from each other by a half pitch (fourth embodiment)
Figure 25A:
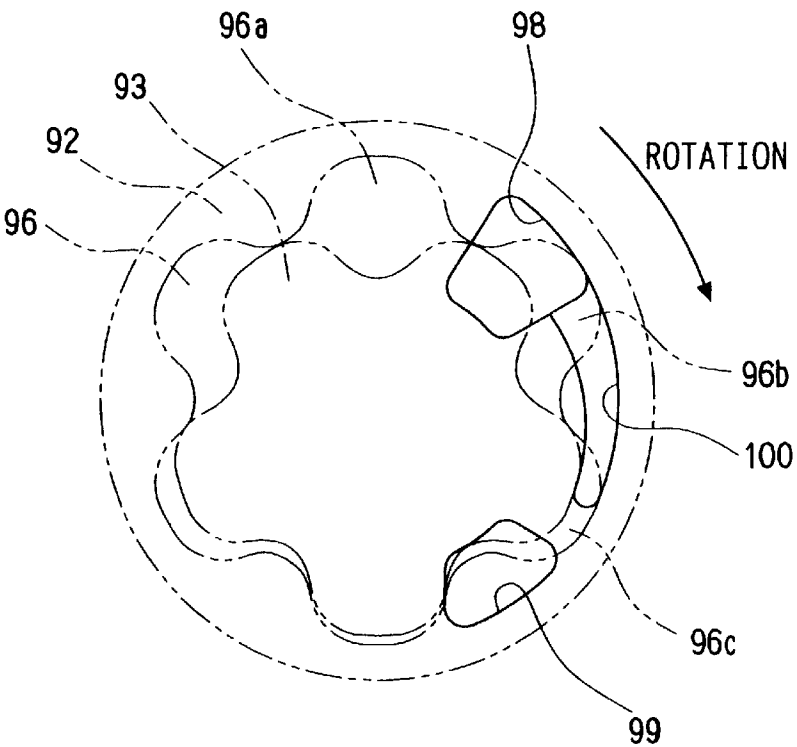

FIG. 25A shows rotation positions of the inner gear 93 and the outer gear 92 when the volume of a pump chamber 96*a* in a boundary region between a suction region and a discharge region becomes maximum, and FIG. 25B shows a state where the inner gear 93 and the outer gear 92 rotates by a half pitch from the position of FIG. 25A. Also in this fourth embodiment, similarly to the third embodiment, as shown in FIG. 25A, the upstream side discharge port 98 is formed over a length of an almost half pitch from a partition position between the pump chamber 96*a* having the maximum volume and an adjacent pump chamber 96*b*, and the downstream side discharge port 99 is formed at a position separated from the upstream side discharge port 98 by about 1.5 pitches in the rotation direction. By this, remaining fuel in the pump chamber 96*b* adjacent to the pump chamber 96*a* having the maximum volume is discharged from the downstream side discharge port 99 with a delay of an almost half pitch from the time when part of the fuel in the pump chamber 96*a* having the maximum volume shown in FIG. 25A starts to be discharged from the upstream side discharge port 98, and the phases of the discharge pressure pulsations of the two discharge ports 98, 99 are shifted by an almost half wavelength and are merged while interfering with each other.

In the fourth embodiment, the upstream side and downstream side end portions of the respective discharge ports 98, 99 are not squeezed but the whole of each of the discharge ports 98, 99 is formed to be substantially rectangular, so that an opening area of each of the discharge ports 98, 99 to the pump chamber 96 can be made large.

Further, in the casing cover 22, a communicating groove portion 100 having a predetermined step (for example, 0.1 mm) with respect to the lower surface of the casing cover 22 is formed to extend from the downstream side end portion of the upstream side discharge port 98 in the rotation direction. By this, as shown in FIG. 25B, the pump chamber 96*b* having passed through the upstream side discharge port 98 communicates with the upstream side discharge port 98 through the communicating groove portion 100. When this pump chamber 96*b* moves from the position shown in FIG. 25A by a half pitch and reaches the position shown in FIG. 25B, the pump chamber 96*b* starts to communicate with the downstream side discharge port 99, and further, when it moves from the position shown in FIG. 25B by the half pitch, it moves to the position of a pump chamber 96*c* shown in FIG. 25A.

In this case, the length of the communicating groove portion 100 in the rotation direction is set so that the tip portion of the communicating groove portion 100 communicates with the pump chamber 96*c* for discharging fuel to the downstream side discharge port 99. By this, at the rotation position shown in FIG. 25A, the upstream side discharge port 98 communicates with the downstream side discharge port 99 through the communicating groove portion 100 and the pump chamber 96*c*.

In the pump portion 90 constructed as described above, with a delay of a half pitch from the time when the fuel in the pump chamber 96*c* shown in FIG. 25A starts to be discharged from the upstream side discharge port 98, the fuel in the pump chamber 96*b* shown in FIG. 25B is discharged from the downstream side discharge port 99, and the phases of the discharge pressure pulsations of the two discharge ports 98 and 99 are shifted by the almost half wavelength and are merged while interfering with each other.

Here, as shown in FIG. 25B, part of the fuel pressurized in the pump chamber 96*b* having passed through the upstream side discharge port 98 flows backward through the communicating groove portion 100 and flows into the upstream side discharge port 98. By this, in the upstream side discharge port 98, two discharge pressure pulsations discharged from the two adjacent pump chamber 98*a*, 98*b* and having shifted phases come to interfere with each other, and the discharge pressure pulsation of the upstream side discharge port 98 is reduced by the interference effect.

Further, as shown in FIG. 25A, since the communicating groove portion 100 is formed so as to communicate with the pump chamber 96*c* for discharging the fuel into the downstream side discharge port 99, the upstream side discharge port 98 and the downstream side discharge port 99 communicate with each other through the communicating groove portion 100 and the pump chamber 96*c*. By this, in the downstream side discharge port 99, the discharge pressure pulsation of the pump chamber 96*c* for discharging the fuel to the downstream side discharge port 99 comes to interfere with the discharge pressure pulsation propagated from the upstream side discharge port 98 through the communicating groove portion 100 and the pump chamber 96*c*. As described above, since the discharge pressure pulsation propagated from the upstream side discharge port 98 goes ahead of the discharge pressure pulsation of the downstream side discharge port 99 by the almost half wavelength, the discharge pressure pulsation of the downstream side discharge port 99 is effectively reduced by the interference of these two discharge pressure pulsations.

Accordingly, according to the fourth embodiment, in the state where both the discharge pressure pulsation of the upstream side discharge port 98 and the discharge pressure pulsation of the downstream side discharge port 99 are reduced by the communicating groove portion 100, the phases of the discharge pressure pulsations of these two discharge ports 98, 99 are shifted by the almost half wavelength and are merged while interfering with each other in the outer flow path of the pump portion 90, the reduction effect of discharge pressure pulsation of the whole pump can be further improved, and noise and vibration by the discharge pressure pulsation can be effectively reduced.

In the fourth embodiment, although the length of the communicating groove portion 100 in the rotation direction is set so that the communicating groove portion 100 communicates with the pump chamber 96*c* for discharging the fuel to the downstream side discharge port 99, the length of the communicating groove portion 100 may be made short so that it does not reach the pump chamber 96*c*. Also in this case, it is possible to obtain the reduction effect of the discharge pressure pulsation of the upstream side discharge port 98 by the communicating groove portion 100.

(Fifth Embodiment)

Hereinafter, the fifth embodiment of the present invention will be described with reference to FIGS. 26–28. First, the whole structure of a trochoid gear type fuel pump will be described in brief with reference to FIG. 26. A motor portion 112 and a trochoid gear type pump portion 113 are fitted in a cylindrical housing 111 of the fuel pump. A pump cover 114 covering the lower surface of the pump portion 113 is mechanically fixed to a lower end of the housing 111, and fuel in a fuel tank (not shown) is sucked from a fuel suction port 115 formed in this pump cover 114 into the pump portion 113. A motor cover 116 for covering the motor portion 112 is mechanically fixed to the an upper end of the housing 111, and a connector 117 for applying electric power to the motor portion 112 and a fuel discharge port 118 are provided in this motor cover 116. The fuel discharged from the pump portion 113 passes through a gap between an armature 119 and a magnet 120 and is discharged from the fuel discharge port 118.

Next, a structure of the trochoid gear type pump portion 113 will be described with reference to FIGS. 26 and 27. A casing of the pump portion 113 is constructed by closing opening portions of a cylindrical pump casing 121 at both upper and lower sides with a casing cover 122 and an inner side cover 123, these three parts are fastened and fixed by a screw 124, and together with the pump cover 114, they are press inserted in the housing 111 and are mechanically fixed. An outer gear 125 and an inner gear 126 are housed in the pump casing 121.

Figure 27:
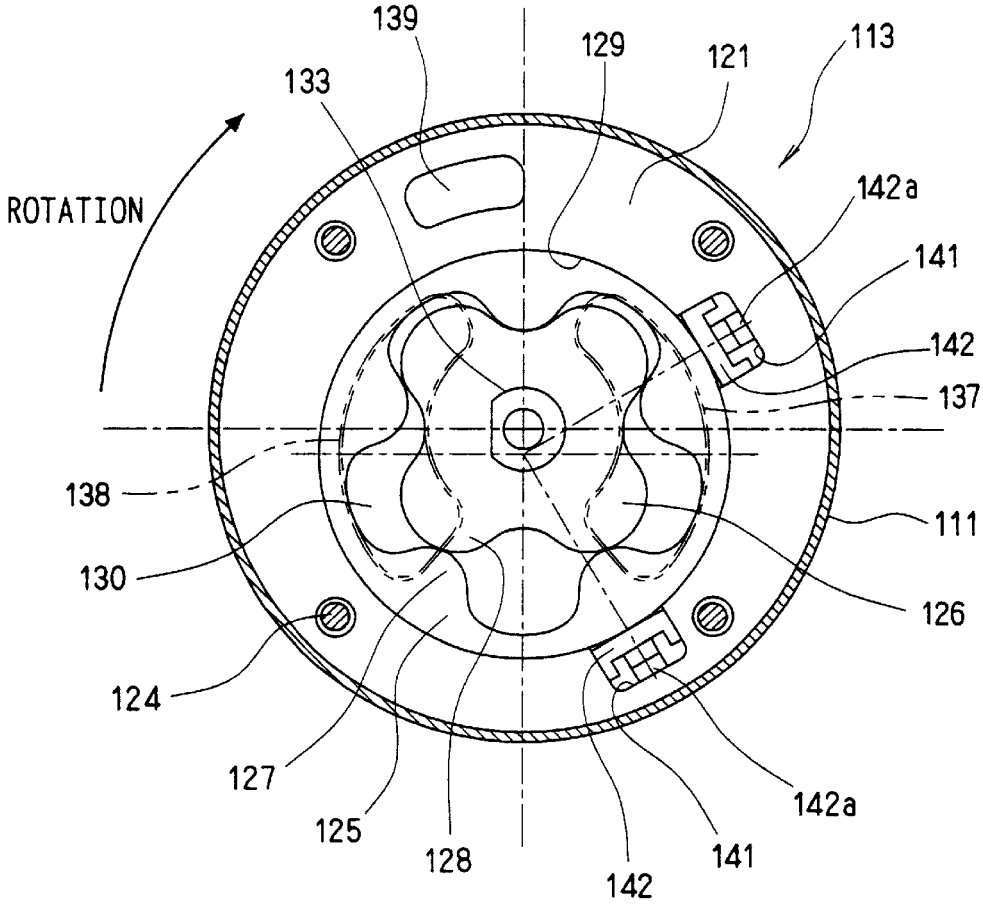
FIG. 27 is a cross-sectional view taken along line XXVII—XXVII in FIG. 26 (fifth embodiment)
Figure 28:
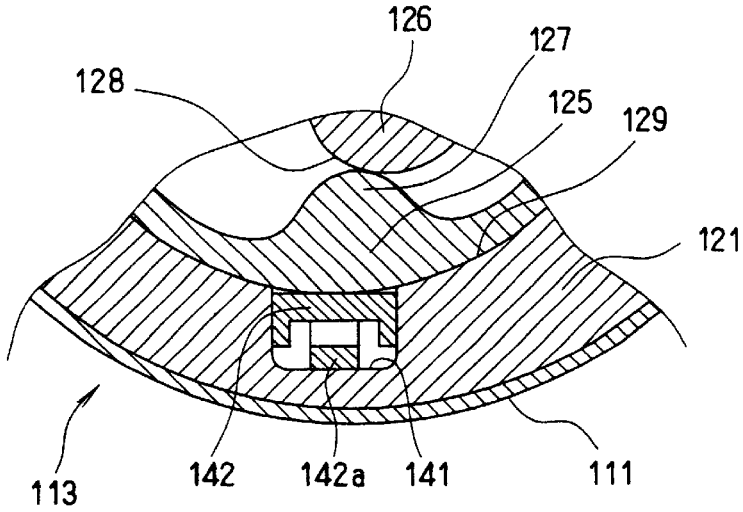
FIG. 28 is an enlarged cross-sectional view showing an arrangement state of an elastic press member (fifth embodiment).

As shown in FIG. 27, inner teeth 127 and outer teeth 128 are respectively formed at an inner peripheral side of the outer gear 125 and an outer peripheral side of the inner gear 126, and the number of teeth of the outer teeth 128 of the inner gear 126 is made smaller than the number of teeth of the inner teeth 127 of the outer gear 125 by one. The tooth thickness of the inner gear 126 is made the same as the tooth thickness of the outer gear 125. The outer gear 125 is rotatably fitted in a circular hole 129 eccentrically formed in the pump casing 121, and a necessary and minimum clearance is formed in the fitting portion (sliding portion) in view of production tolerance, sliding resistance, and the like. The thickness dimension (dimension in an axial direction) of the outer gear 125 is smaller than the thickness dimension of the pump casing 121 by the side clearance.

The inner gear 126 is eccentrically housed at the inner peripheral side of the outer gear 125, and a plurality of pump chambers 130 are formed between the teeth 127 and 128 by engagement or contact of the teeth 127, 128 of both the gears 125, 126. In this case, since the outer gear 125 and the inner gear 126 are mutually eccentric, the amounts of engagement of the teeth 127, 128 of both the gears 125, 126 are continuously increased and decreased at the time of rotation, and an operation of continuously increasing and decreasing the volumes of the respective pump chambers 130 is repeated at a period of one rotation.

Figure 26:
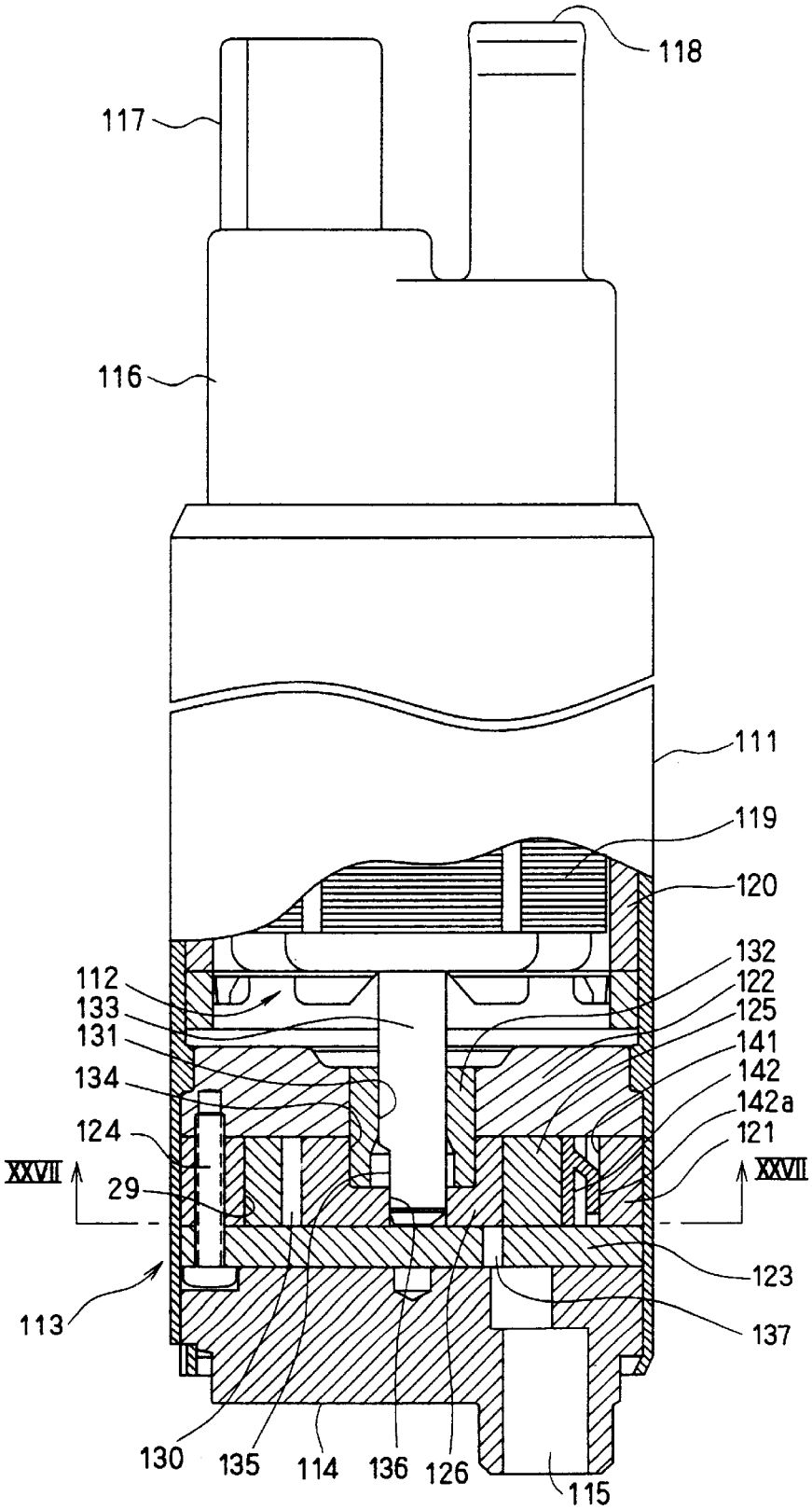
FIG. 26 is a partial cross-sectional view showing a main portion of a fuel pump (fifth embodiment)

As shown in FIG. 26, a cylindrical bearing 132 is fitted in an insertion hole 131 formed at a center portion of the casing cover 122, and a rotating shaft 133 of the motor portion 112 is rotatably inserted in and supported by an inner diameter portion of the bearing 132. This bearing 132 protrudes into the inner gear 126 by an almost half of its thickness, and an axial hole 134 formed at the center portion of the inner gear 126 is rotatably fitted to the bearing 132. The rotating shaft 133 of the motor portion 112 protrudes downward from the bearing 132, and a D-cut portion 135 formed at the protruding portion is fitted in a D-shaped connecting hole 136 formed at a lower portion of the axial hole 134 of the inner gear 126. By this, when the rotating shaft 133 of the motor portion 112 is rotated, the inner gear 126 is rotated together with this, and further, the outer gear 125 engaging with this inner gear 126 is also rotated. Incidentally, a coupling may be used as connecting means of the rotating shaft 133 of the motor portion 112 and the inner gear 126.

A suction port 137 for sucking fuel from a fuel suction port 115 into the pump chambers 130 is formed in the inner side cover 123. As shown in FIG. 27, this suction port 137 is formed into a bow shape so that it is extended like a groove in a circumferential direction along an inside surface of the inner side cover 123 and communicates with the plurality of pump chambers 130 in which the volumes are increased by the rotation of the gears 125, 126.

Further, in the inner side cover 123, a discharge port 138 (see FIG. 27) is formed at a position opposite to the suction port 137 by about 180°. This discharge port 138 is formed into a bow shape so that it is extended like a groove in a circumferential direction along the inside surface of the inner side cover 123 and communicates with the plurality of pump chambers 130 in which the volumes are decreased by the rotation of the gears 125, 126. The fuel discharged from this discharge port 138 is discharged to the side of the motor 112 through passages of a discharge groove (not shown) of the inner surface of the pump cover 114→a through hole (not shown) of the inner side cover 123→a through flow path 139 (see FIG. 27) of the pump casing 121→a through flow path (not shown) of the casing cover 122. A discharge port may be formed in the casing cover 122 to directly discharge fuel from this discharge port to the side of the motor portion 112.

As described above, when the inner gear 126 is rotated and driven by the motor portion 112, the outer gear 125 engaging with this inner gear 126 is rotated, the amounts of engagement of the teeth 127, 128 of both the gears 125, 126 are continuously increased and decreased, and the operation of continuously increasing and decreasing the volumes of the respective pump chambers 130 is repeated at a period of one rotation. By this, in the pump chambers 130 in which the volumes are increased, the fuel is transferred in the rotation direction of both the gears 125, 126 while being sucked from the suction port 137, and in the pump chambers 130 in which the volumes are decreased, the transferred fuel is discharged from the discharge port 138 while being pressurized.

Next, a structure in which the outer gear 125 is pressed to the pump casing 121 in one direction by an elastic force, will be described At the side of the suction port 137 in the inner peripheral portion of the pump casing 121, two housing recesses 141 are formed at about 90° intervals, and an elastic press member 142 (elastic press means) is housed in each of the housing recesses 141. The respective elastic press member 142 is made of an elastic material (for example, nylon, etc.) having low sliding resistance to the outer gear 125 and excellent in wear resistance and gasoline resistance, and an elastic piece portion 142*a* is integrally formed. The elastic piece portion 42*a* of the respective elastic press member 142 is in contact with the bottom of the housing recess 141, and the elastic press member 142 is pressed to the outer peripheral surface of the outer gear 125 by the elastic deformation of the elastic piece portion 142*a*, so that the outer gear 125 is pressed to the pump casing 121 in one direction.

In this case, in the region at the side of the discharge port 138 where the volume of the pump chamber 130 is decreased, since the fuel in the pump chamber 130 is pressurized and the fuel pressure rises, a load in the outer diameter direction is applied to the outer gear 125 by the rise of the fuel pressure. Since such load by the rise of the fuel pressure is not produced in the region at the side of the suction port 137 where the fuel pressure in the pump chamber 130 is lowered, the load in the outer diameter direction by the fuel pressure to the outer gear 125 comes to affect only the region at the side of the discharge port 138 where the fuel pressure of the pump chamber 130 is raised.

In view of this, the direction in which the respective elastic press members 142 press the outer gear 125, passes through the rotation center of the outer gear 125, and the direction of the resultant force of the pressing forces is directed to the bow-shaped discharge port 138. By this, since the affecting directions of the elastic forces of the elastic press members 142 affecting the outer gear 125 and the fuel pressure become almost identical to each other, the outer gear 125 is kept in the state where it is pressed to the pump casing 121 by the elastic forces of the elastic press members 142 and the fuel pressure.

Here, during the rotation of both the gears 125, 126, in addition to the fuel pressure of the pump chamber 130, a force to press the outer gear 125 is produced also by the rotation driving force applying from the inner gear 126 to the outer gear 125. Accordingly, the direction in which the elastic press members 142 press the outer gear 125 may be set to a direction of a resultant force of the pressing force to the outer gear 125 produced by the fuel pressure of the pump chamber 130 and the pressing force to the outer gear 125 produced by the rotation driving force of the inner gear 126. The direction of the resultant force is set in the range of the discharge port 138.

According to the embodiments described above, since the outer gear 125 is pressed toward the discharge port 138 by the two elastic press members 142, the operation directions of the elastic force of the elastic press members 142 affecting the outer gear 125 and the fuel pressure become almost identical to each other, and the outer gear 125 can be certainly pressed to the inner peripheral surface of the pump casing 121 at the side of the discharge port 138 by the elastic force of the elastic press members 142 and the fuel pressure. By this, jolting and whirling of the outer gear 125 can be suppressed, and noise and vibration due to the jolting and whirling of the outer gear 125 can be effectively reduced.

Further, since the fuel pressure can be effectively used as the load to press the outer gear 125 to the pump casing 121, the elastic force of the elastic press members 142 necessary for suppressing the jolting and whirling of the outer gear 125 may be small by the fuel pressure, and by that, the cost of the elastic press member 142 can be reduced.

However, in the present embodiment, the outer gear 125 may be pressed in a direction other than the discharge port 138 by the elastic press member 142 (elastic press means), and also in this case, the jolting and whirling of the outer gear 125 can be suppressed by increasing the elastic force of the elastic press member 142 to a certain degree.

Further, in the present embodiment, since the outer gear 125 is pressed in one direction by the two elastic press members 142, the press direction of the outer gear 125 by the elastic press members 142 can be stabilized, and the outer gear 125 can be stably pressed in the direction of the side of the discharge port 138 without receiving the influence of production fluctuation or the like. Even when three or more elastic press members 142 are provided, the same effect can be obtained, and the arrangement interval of the respective elastic press members 142 may be suitably changed. However, in the present embodiment, only one elastic press member 142 may be provided, and also in this case, the desired object of the present invention can be achieved.

Further, in the present embodiment, although the elastic piece portion 142*a* is integrally formed with the elastic press member 142, a spring member such as a separate spring may be housed in the housing recess 141, and the elastic press member may be pressed to the outer gear 125 by the elastic force of this spring member.

Moreover, the present invention can be variously modified and carried out in the scope not departing from the gist, for example, the number of teeth of the outer gear 125 and the inner gear 126 may be suitably changed.

What is claimed is:

1. A trochoid fuel pump comprising:

a single pair of inner and outer gears, said outer gear including inner teeth, said inner gear including outer teeth being eccentrically arranged at an inner periphery of said outer gear, said inner gear engaging with said outer gear to define pump chambers between the teeth thereof for forming a pump, wherein volumes of said pump chambers are continuously increased and decreased to suck and discharge fuel while said pump chambers are moved in a rotation direction by rotation of both said gears, said pump includes two discharge ports through which the fuel is discharged, each of said discharge ports being arranged so that said pump chambers sequentially communicate with said discharge ports, phases of discharge pressure pulsations of the fuel discharged from said two discharge ports are shifted from each other by an almost half wavelength, the fuel discharged from said two discharge ports is merged, said discharge ports include an upstream side discharge port and a downstream side discharge port, a start position of said upstream side discharge port is located in a vicinity of an end of a pump chamber which becomes maximum in volume, an end position of said upstream side discharge port is located in a vicinity of an end of a pump chamber which is formed when both said gears move by half phase, and a start position of said downstream side discharge port is located in a vicinity of an end of a pump chamber next to the end position of said upstream side discharge port when both said gears move by half phase.

2. The trochoid fuel pump according to claim 1, further comprising a housing in which said pair of gears are housed, said housing defining a common passage to which said two discharge ports are directly opened.

3. The trochoid fuel pump according to claim 2, further comprising motor components housed in the housing, for providing a motor for driving said pair of gears.

4. The trochoid fuel pump according to claim 2, wherein said housing is formed in a cylindrical shape, and said pump has a casing disposed on an axial end of said housing, the casing rotatably housing said pair of gears, and the casing defining a suction port on a side surface that faces outside of the housing and defining said discharge ports on a side surface that faces inside of the housing.

5. The trochoid fuel pump according to claim 1, wherein a half area of said pump chamber which has become maximum in volume overlaps with said upstream side discharge port when both said gears move by half phase, a pump chamber next to said pump chamber which becomes maximum in volume is located between said vicinity of said end position of said upstream side discharge port and said vicinity of said start position of said downstream side discharge port.

6. The trochoid fuel pump according to claim 1, wherein said inner gear and said outer gear are covered by a first cover and a second cover, said first cover includes a fuel suction port and covers one end of said gears in an axial direction of a shaft, said second cover includes said discharge ports and covers other end of said gears in said axial direction, said fuel suction port and said discharge ports are arranged at each end of the gears in said axial direction.

7. The trochoid fuel pump according to claim 1, wherein the number of teeth of said inner gear is odd, and the number of said outer gear is even.

8. A trochoid fuel pump comprising:

a single pair of inner and outer gears, said outer gear including inner teeth, said inner gear including outer teeth being eccentrically arranged at an inner periphery of said outer gear, said inner gear engaging with said outer gear to define pump chambers between the teeth thereof for forming a pump, wherein volumes of said pump chambers are continuously increased and decreased to suck and discharge fuel while said pump chambers are moved in a rotation direction by rotation of both said gears, said pump includes two discharge ports through which the fuel is discharged, each of said discharge ports being arranged so that said pump chambers sequentially communicate with said discharge ports, phases of discharge pressure pulsations of the fuel discharged from said two discharge ports are shifted from each other by an almost half wavelength, the fuel discharged from said two discharge ports is merged, and a communicating groove portion extending in the rotation direction from an upstream side discharge port of said two discharge ports, and wherein said pump chamber having passed through said upstream side discharge port communicates with said upstream side discharge port through said communicating groove portion.

9. The trochoid fuel pump according to claim 8, wherein a length of said communicating groove portion in the rotation direction is set so that said communicating groove portion communicates with said pump chamber for discharging the fuel to a downstream side discharge port of said two discharge ports.

10. A trochoid fuel pump comprising:

a cylindrical housing defining a common fuel passage therein; and a pump portion, the pump portion including:

an outer gear having inner teeth;

an inner gear having outer teeth being eccentrically arranged at an inner periphery of the outer gear, the inner gear engaging with the outer gear to define pump chambers between the teeth thereof; and a casing supported on an end of the cylindrical housing, the casing having an outside surface facing an outside the cylindrical housing and an inside surface facing the common fuel passage defined in the cylindrical housing, the casing rotatably housing the outer gear and the inner gear, the casing defining a suction port on the outside surface for communicating between the pump chambers and the outside of the cylindrical housing, and the casing defining a plurality of discharge ports on the inside surface for communicating between the pump chambers and the common fuel passage, wherein the discharge ports are arranged so that each of said pump chambers sequentially communicates with said discharge ports, and phases of discharge pressure pulsations of the fuel discharged from the discharge ports are shifted from each other by an almost half wavelength and merged in the common fuel passage, wherein the discharge ports include an upstream side discharge port and a downstream side discharge port, a start position of the unstream side discharge port is located in a vicinity of an end of a pump chamber which becomes maximum in volume, an end position of the upstream side discharge port is located in a vicinity of an end of a pump chamber which is formed when both the gears move by half phase, and a start position of the downstream side discharge port is located in a vicinity of an end of a pump chamber next to the end position of the upstream side discharge port when both said gears move by half phase.

11. The trochoid fuel pump according to claim 10, further comprising motor components housed in the housing, for providing a motor for driving the outer and inner gears.

12. A trochoid fuel pump comprising:

a cylindrical housing defining a common fuel message therein; and a pump portion, the pump portion including:

an outer gear having inner teeth;

an inner gear having outer teeth being eccentrically arranged at an inner periphery of the outer gear, the inner gear engaging with the outer gear to define pump chambers between the teeth thereof; and a casing supported on an end of the cylindrical housing, the casing having an outside surface facing an outside the cylindrical housing and an inside surface facing the common fuel passage defined in the cylindrical housing, the casing rotatably housing the outer gear and the inner gear, the casing defining a suction port on the outside surface for communicating between the pump chambers and the outside of the cylindrical housing, and the casing defining a plurality of discharge ports on the inside surface for communicating between the pump chambers and the common fuel passage, wherein the discharge ports are arranged so that each of said pump chambers sequentially communicates with said discharge ports, and phases of discharge pressure pulsations of the fuel discharged from the discharge ports are shifted from each other by an almost half wavelength and merged in the common fuel passage, and a communicating groove portion extending in the rotation direction from an upstream side discharge port of the discharge ports, and wherein the pump chamber having passed through the upstream side discharge port communicates with the upstream side discharge port through the communicating groove portion.

13. The trochoid fuel pump according to claim 12, wherein a length of the communicating groove portion in the rotation direction is set so that the communicating groove portion communicates with the pump chamber for discharging the fuel to a downstream side discharge port of the discharge ports.

* * * * *

UNITED STATES PATENT AND TRADEMARK OFFICE

CERTIFICATE OF CORRECTION

PATENT NO. : 6,761,547 B2
DATED : July 13, 2004
INVENTOR(S) : Takagi et al.

It is certified that error appears in the above-identified patent and that said Letters Patent is hereby corrected as shown below:

Title page,
Item [30], Foreign Application Priority Data,
"Mar. 27, 2000 (JP) …….2000-90748
Mar. 30, 2000 (JP) ……...2000-97793
Nov. 6, 2000 (JP) …….2000-337685" should be
-- Mar. 27, 2000 (JP) ……2000-90748
Mar. 30, 2000 (JP) ……...2000-97793
Nov. 6, 2000 (JP) ……..2000-337685
Feb. 2, 2001 (JP) ……..2001-26269 --

Signed and Sealed this

Fourteenth Day of September, 2004

JON W. DUDAS
*Director of the United States Patent and Trademark Office*